US008490330B2

(12) United States Patent
Lund et al.

(10) Patent No.: US 8,490,330 B2
(45) Date of Patent: Jul. 23, 2013

(54) WINDOW OPENING CONTROL ASSEMBLY

(75) Inventors: David Lund, Detroit Lakes, MN (US); Trevor McCollough, Moorhead, MN (US); Brad Arens, West Fargo, ND (US); Brian Martin, Fargo, ND (US)

(73) Assignee: Integrity Windows and Doors, Warroad, MN (US)

( * ) Notice: Subject to any disclaimer, the term of this patent is extended or adjusted under 35 U.S.C. 154(b) by 190 days.

(21) Appl. No.: 13/006,873

(22) Filed: Jan. 14, 2011

(65) Prior Publication Data

US 2011/0173895 A1 Jul. 21, 2011

Related U.S. Application Data

(60) Provisional application No. 61/295,577, filed on Jan. 15, 2010.

(51) Int. Cl.
*E06B 3/50* (2006.01)
*E05D 15/16* (2006.01)

(52) U.S. Cl.
USPC ..... 49/141; 292/1; 292/200; 16/82 C

(58) Field of Classification Search
USPC ..... 49/141, 394; 70/93, 89.9; 292/1, 292/300, DIG. 20, DIG. 47, DIG. 15, DIG. 61; 16/82, 82 C
See application file for complete search history.

(56) References Cited

U.S. PATENT DOCUMENTS

| | | | | | |
|---|---|---|---|---|---|
| 198,553 | A * | 12/1877 | Von Auer | 292/264 |
| 523,736 | A * | 7/1894 | Cazin | 70/93 |
| 2,062,020 | A * | 11/1936 | Engel | 70/93 |
| 3,897,966 | A * | 8/1975 | Draughon, Sr. | 292/264 |
| 4,027,907 | A * | 6/1977 | Crepinsek | 292/264 |
| 4,263,747 | A * | 4/1981 | Coltrin et al. | 49/56 |
| 4,383,666 | A * | 5/1983 | Allerding et al. | 244/118.5 |
| 4,577,896 | A * | 3/1986 | Crepinsek | 292/264 |
| 4,580,819 | A * | 4/1986 | Crepinsek | 292/264 |
| 4,580,820 | A * | 4/1986 | Baber | 292/264 |
| 4,639,024 | A * | 1/1987 | Crepinsek | 292/264 |
| 4,856,229 | A * | 8/1989 | Tserng | 49/56 |
| 4,897,961 | A * | 2/1990 | Shine | 49/141 |
| 5,647,233 | A * | 7/1997 | Chung | 70/93 |
| 5,669,256 | A * | 9/1997 | Chung | 70/93 |
| 6,634,681 | B1 * | 10/2003 | Redden | 292/92 |
| 6,684,454 | B2 * | 2/2004 | Ehrenreich | 16/197 |
| 8,075,038 | B2 * | 12/2011 | Zielinsky | 296/57.1 |
| 2011/0203184 | A1 | 8/2011 | Nguyen et al. | |

FOREIGN PATENT DOCUMENTS

FR 2572145 A1 * 4/1986

* cited by examiner

*Primary Examiner* — Jerry Redman
(74) *Attorney, Agent, or Firm* — Schwegman Lundberg & Woessner, P.A.

(57) ABSTRACT

A window opening control assembly that includes a first member for attachment to one of a sash or a window frame. The first member includes a locking assembly. The window opening control assembly further includes a second member for attachment to the other of the sash or the window frame. The second member includes a flexible element that extends to the first member. The flexible element is secured by the locking assembly such that the flexible element is fed from the second member as the second member is moved away from the first member until the flexible element is anchored within the second element and the second element is correspondingly restrained from moving further away from the first member. The locking assembly is selectively unlocked to permit removal of the flexible element from the locking assembly and permit continued movement of the second member away from the first member.

31 Claims, 28 Drawing Sheets

WINDOW OPENING CONTROL ASSEMBLY

CLAIM OF PRIORITY

This patent application claims the benefit of priority, under 35 U.S.C. §119(e), to U.S. Provisional Patent Application Ser. No. 61/295,577, entitled "WINDOW OPENING CONTROL ASSEMBLY AND RELATED METHODS," filed on Jan. 15, 2010, which is hereby incorporated by reference herein in its entirety.

TECHNICAL FIELD

Window opening control assemblies that limit the degree of opening of a sash.

BACKGROUND

Windows include an operable sash which can be opened for ventilation of a room. However, when such windows are used in taller buildings or homes, for instance with a second floor, open windows can pose a risk to certain groups of people, such as children. For instance, a child may crawl or fall out of an open window. Even in windows installed on a first floor a child can fall an appreciable distance and suffer injury.

SUMMARY

An operable window assembly includes a frame, and a sash movably coupled relative to the frame. The sash has a closed position, a stop position, a number of open positions, and a fully open position. The window assembly further includes a window opening control assembly coupled with the frame and the sash. The window opening control assembly can be retractable, and can include telescoping members. The window opening control assembly can be used with windows, doors, sliding doors, swinging doors, patio doors, freezer doors, cabinet doors, skylights, roof hatch, roof access doors, etc.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1A:
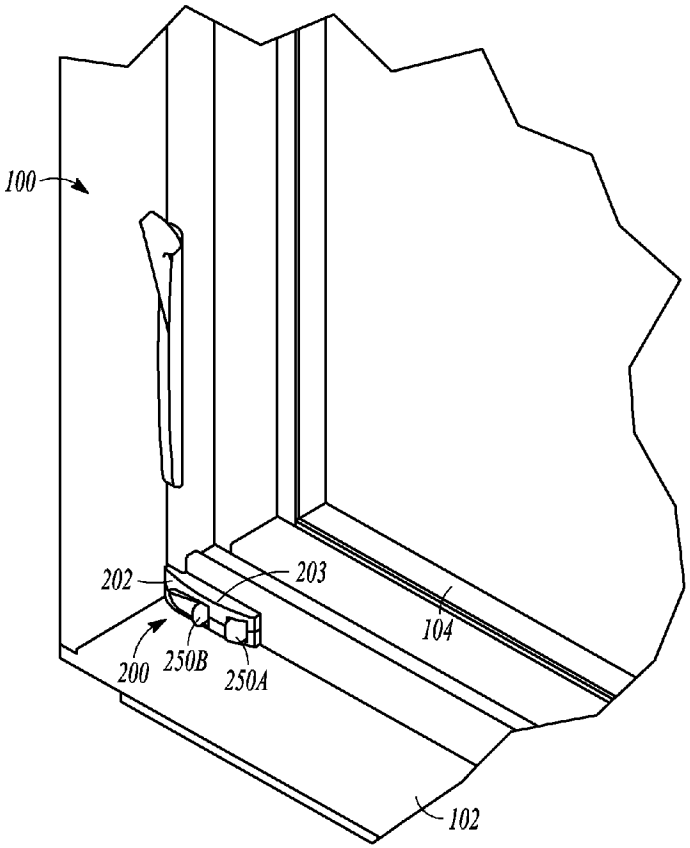
FIGS. 1A-1C are perspective views of a window assembly with a window opening control assembly illustrating the window assembly in a closed position, an intermediate stop position and an open position, as constructed in accordance with one embodiment.
Figure 1B:
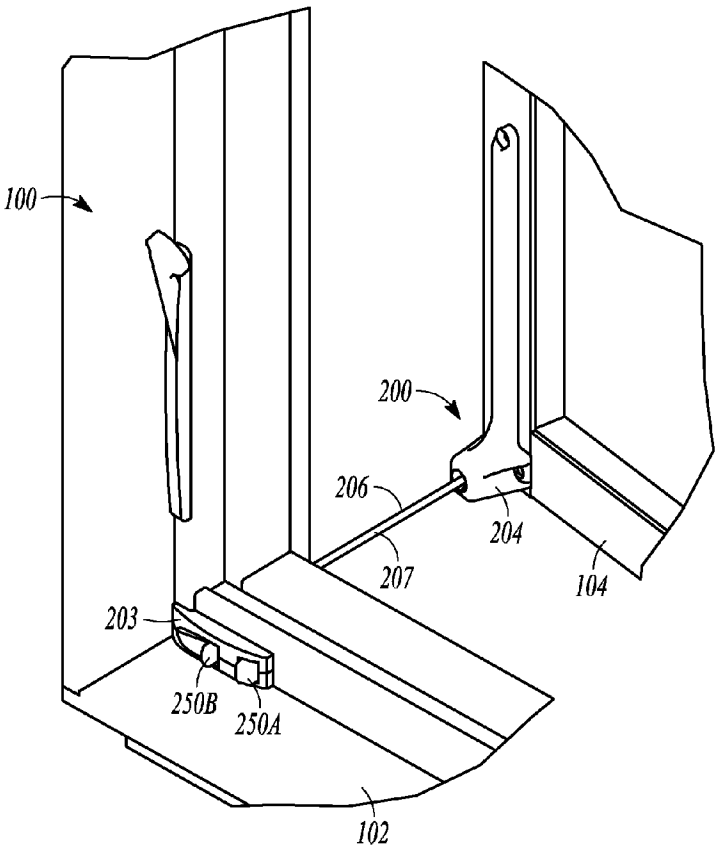
Figure 1C:
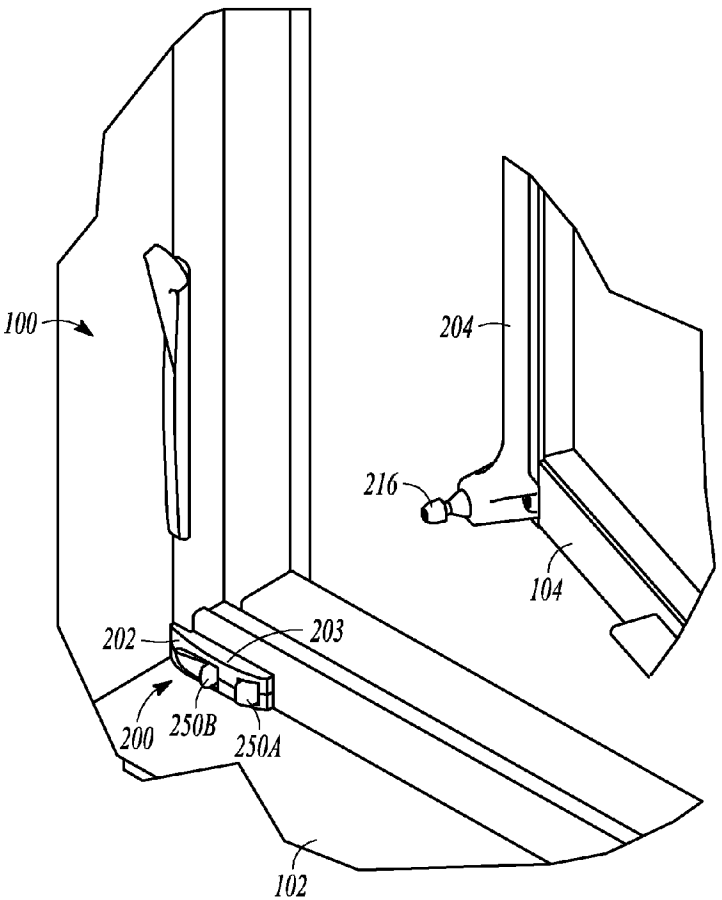

A window assembly 100, such as, but not limited to, a casement window, is shown in FIGS. 1A-1C. It should be noted the window assembly 100 can be a casement window, which operates with a rotatable sash that rotates around a vertical axis. In another option, the window assembly 100 includes an awning window, where a sash rotates about a horizontal axis. In yet another option, the window assembly 100 can include a push-out window, where a worm gear assembly may not be necessary. The assembly 100 can further include, but is not limited to, windows, doors, sliding doors, swinging doors, patio doors, freezer doors, cabinet doors, skylights, roof hatch, roof access doors, etc.

In an option, the window assembly 100 includes a frame 102 and a sash 104 rotatably coupled relative to a frame 102.

For example, the sash 104 rotates about a vertical axis. In an example, at least one pane of glass is retained within the sash 104. In an option, the window assembly 100 includes a window drive mechanism and a window opening control assembly 200. It should be noted that as used herein, the window opening control assembly 200 may be used with windows, doors, sliding doors, swinging doors, patio doors, freezer and refrigerator doors, cabinet doors, skylights, roof hatches, roof access doors and the like.

The window opening control assembly 200 is coupled with the sash 104 and the frame 102, and is configured to limit the amount of travel of the sash 104 relative to the frame 102. The window opening control assembly 200 can be released or by-passed to allow full opening of the sash 104 to an infinite number of open positions or to a fully open position.

FIG. 1A is a perspective view illustrating the window assembly in a closed position. FIG. 1B is a perspective view illustrating the window assembly in a stopped intermediate position. FIG. 1C is a perspective view illustrating the window assembly in an open position.

As shown in FIGS. 2A-2F, the window opening control assembly 200 includes a first member 202, such as a locking assembly, coupled with the frame 102, a second member 204, such as a housing, coupled with the sash 104, and a flexible element 206 (see FIGS. 1B, 2B, 2D-2F) coupled between the first member 202 and the second member 204. The second member 204 is not visible in the closed position shown in FIG. 1A because it is concealed by portions of the window frame 102.

As the sash 104 is opened (e.g., a sash 104 for a casement window in this example), the flexible element 206 extends from the second member 204 until it reaches a cable stop 210 (see FIGS. 1B, 2B), which prevents the sash 104 from opening further. In another option, the compression of the compression spring 212 assists in providing the stop, where the hole 209 (see FIG. 2D) allows for passage of the flexible element 206, but a travel stop 211 does not allow passage of the spring 212. For example, the travel stop 211 can include a counter bore to receive a portion of the spring 212 therein. In yet another option, the bias member is a torsion spring. In the stop position, the sash 104 is opened to an opening of approximately 2-5 inches in width, for example, between the vertical portion of the sash 104 (i.e., the outer most portion of the sash) and the frame 102. For other types of windows and doors the width would be measured from the movable panel to the frame. In a further option, a re-coil mechanism such as a spring 212 is disposed between the stop 210 and a portion of the second member 204. The spring 212 further allows for the automatic retraction of the first member 202 relative to the second member 204. Other methods can be used to automatically retract the first member 202 relative to the second member 204.

The window opening control assembly 200 can be released, for instance with a multi-step operation. In an option, the window opening control assembly 200 is opened with a two-step operation, which may be less obvious to children to operate. In an option, the multi-step operation includes pressing a first release, and operating a second release. For instance, the first release is a button that is pressed, which allows operation of a lever. The second release, the lever, is depressed and allows for the first member 202 to be uncoupled from the flexible element 206.

In an option, a release member 216 is fixedly coupled with the flexible element 206, and the release member 216 is releasably coupled with the first member 202. In another option, the first and second members 202, 204 are reversed and coupled with the sash 104 and the frame 102, respectively.

As used herein, the release member 216 refers to, among other items, an anchor, catch and/or stop.

Figure 2A:
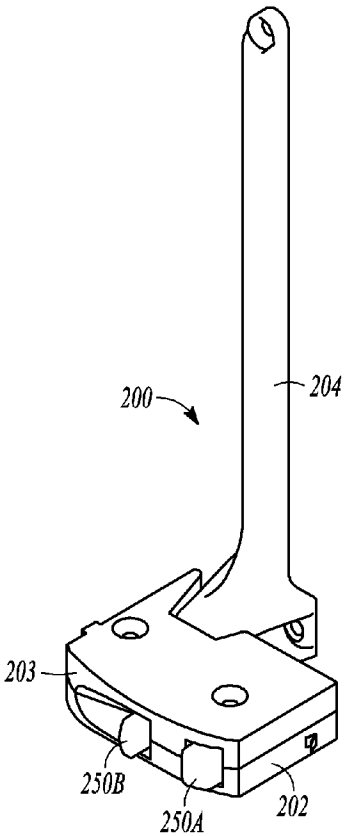
FIG. 2A is an exploded perspective view of a window opening control assembly illustrating the window opening control assembly in a closed position as constructed in accordance with one embodiment.
Figure 2B:
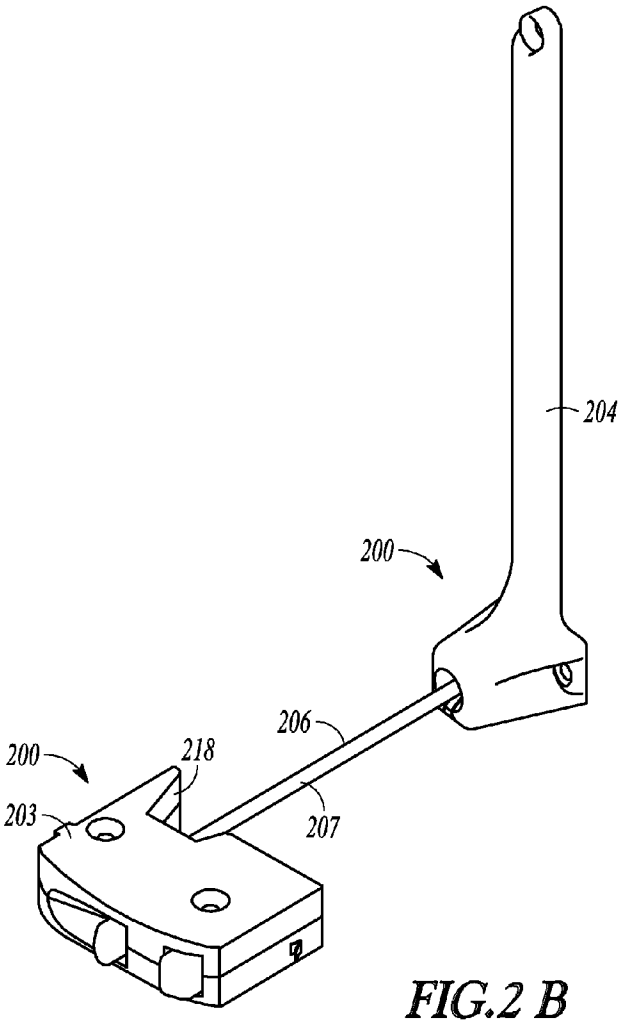
FIG. 2B is a perspective view of a window opening control assembly illustrating the window opening control assembly in an intermediate stopped position as constructed in accordance with one embodiment.
Figure 2C:
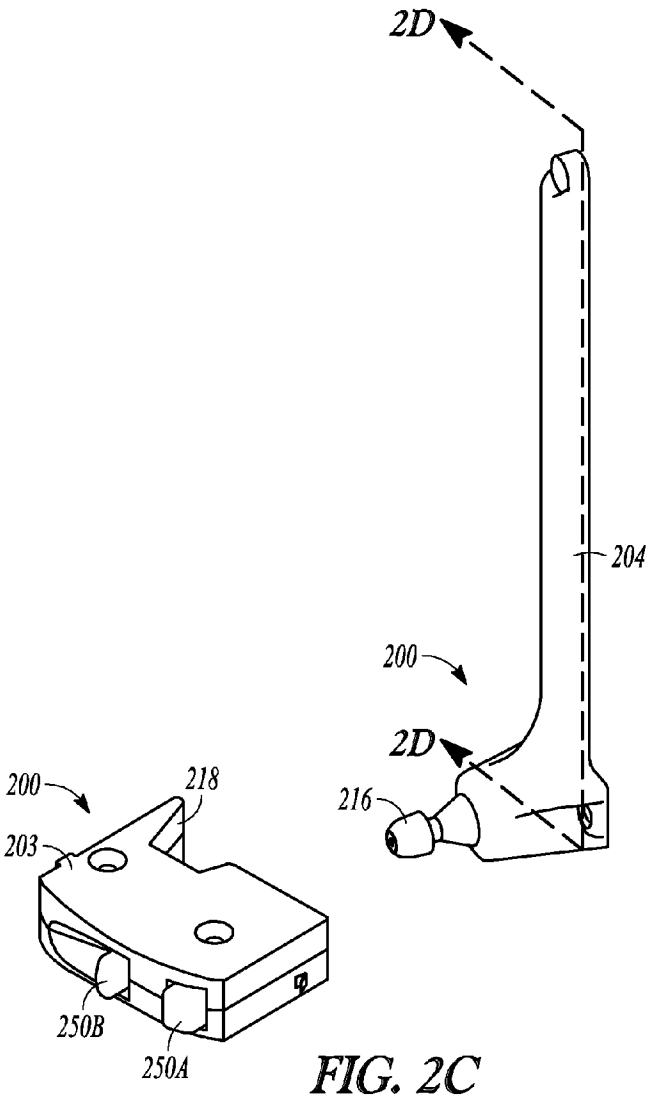
FIG. 2C is an exploded perspective view of a window opening control assembly illustrating the window opening control assembly in an example open position as constructed in accordance with one embodiment.

In the example window opening control assembly 200 that is shown in FIGS. 2A-2C, the window opening control assembly 200 includes a first member 202 for attachment to one of a sash 104 or a window frame 102. The first member 202 includes a locking assembly 203.

Figure 2F:
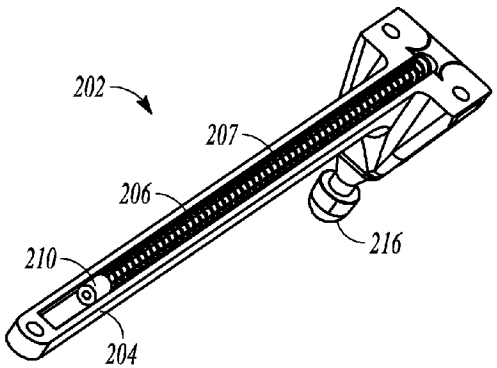
FIG. 2F is a rear perspective view of the member shown in FIGS. 2D-2E.
Figure 2D:
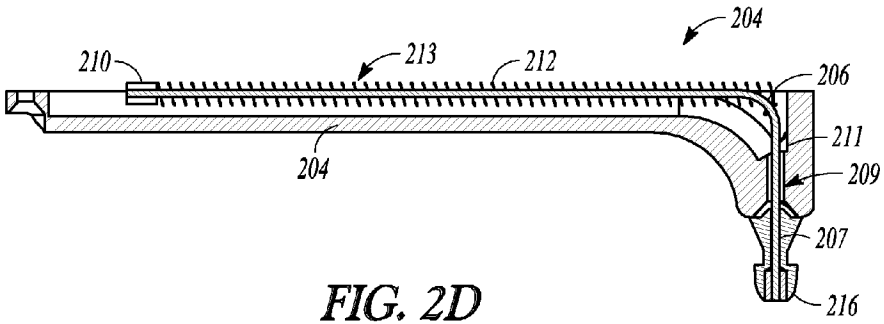
FIG. 2D is a schematic section view of an example member that is illustrated in the window opening control assembly shown in FIGS. 2A-2C.
Figure 2E:
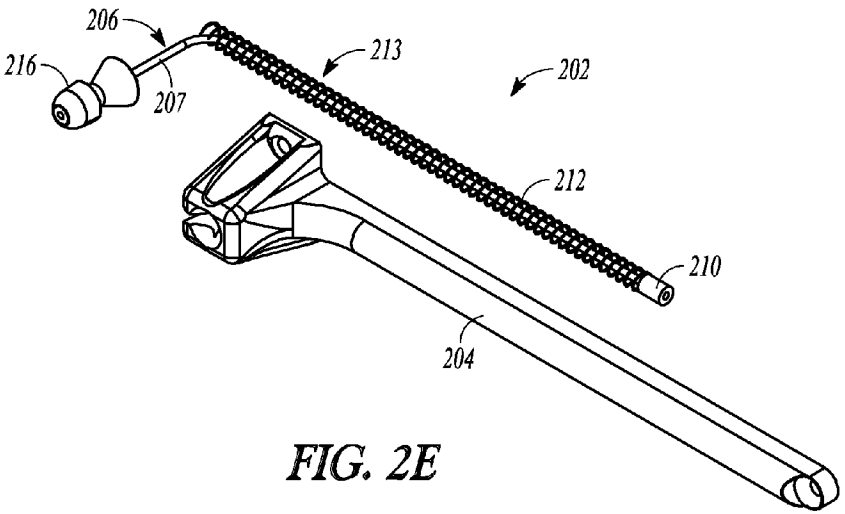
FIG. 2E is an exploded perspective view of the member shown in FIG. 2D.

The window opening control assembly 200 further includes a second member 204 for attachment to the other of the sash 104 or the window frame. FIGS. 2D-2F provide additional illustration for the example second member 204. As shown most clearly in FIGS. 2B and 2D-2F, the second member 204 includes a flexible element 206 that extends to the first member 202. The flexible element 206 is secured by the locking assembly 203 (FIGS. 1A, 2A).

During operation, the flexible element 206 is fed from the second member 204 as the second member 204 is moved away from the first member 202 until the flexible element 206 is anchored within the second element 204 and the second element 204 is correspondingly restrained from moving further away from the first member 202 (FIGS. 1B, 2B). The flexible element 206 remains secured with the locking assembly 203 during operation of the sash from a closed toward an open position. As the flexible element 206 is fed from the second member 204 the engagement of one end of the flexible element 206 with the first member 202 ensure the flexible element is pulled from the second member 204. After the flexible element 206 is fully deployed, the element remains engaged with the locking assembly 203 and anchors the second member 204 at the partially open position.

FIG. 2A shows the first member 202 and the second member 204 positioned adjacent to one another, which corresponds to a situation where the sash 104 is in a closed position. FIG. 2B shows the first member 202 and the second member 204 separated from one another in an intermediate stopped position where there is no more flexible element available 206 to be fed from the first member 202 until the flexible element 206 is unlocked from the locking assembly 203. That is to say, while the flexible element 206 is coupled with the locking assembly 203 the flexible element prevents further movement of the second member 204 relative to the first member 202 because the flexible element is anchored within the locking assembly 203 and is similarly engaged at an opposed portion of the flexible element within the second member 204 (e.g., with a stop, plug or other feature positioned along the flexible element 206).

As shown FIG. 2C, during operation of the window opening control assembly 200 in order to further open the sash 104 relative to the window frame 102, the locking assembly 203 is selectively unlocked to permit removal of the flexible element 206 from the locking assembly 203 and to permit continued movement of the second member 204 away from the first member 202. Further description and figures showing multiple examples of locking assemblies are provided below.

In the example window opening control assembly 200 that is shown in FIGS. 2B, 2D-2F, the flexible element 206 includes a tether 207 that has an anchor 216 (e.g., a release member) at the end of the tether 207 such that the anchor 216 is restrained by the locking assembly 203 until the locking assembly 203 is deactivated to permit the anchor 216 to be removed from the locking assembly 203.

Embodiments are contemplated where the flexible element 206 is a rope, line, tape, wire, ribbon, cord and/or cable. The type of flexible element 206 that is utilized in the window opening control assembly 200 will depend in part on the type of locking assembly 203 used to secure the flexible element 206 when the first and second members 202, 204 are moved adjacent to one another to engage the flexible element 206 with the locking assembly 203. As an example, the flexible element 206 may be a metal ribbon that is vertically oriented relative to the window to maintain stiffness vertically yet permit rotation horizontally in the case of a casement window. In such an embodiment optionally the locking assembly 203 may be situated on the vertical member of the frame 102.

As shown most clearly in FIGS. 2A-2F, the second member may include a re-coil mechanism 213 that is configured to retract the tether 207 from the locking assembly 203 when the locking assembly 203 is selectively unlocked. In some embodiments, the re-coil mechanism 213 includes a spring 212 that is disposed between a stop 210 and a portion of the second member 204. The spring 212 allows for automatic retraction of the first member 202 relative to the second member 204 when the anchor is released from the locking assembly 203.

Although the spring 212 is illustrated as a compression spring, other types of springs may be used to provide retraction of the flexible element 206 (e.g., a torsion spring). In addition, other methods may be used to automatically retract the flexible element 206 relative to the second member 204.

In some embodiments, the locking assembly 203 includes one or more actuators that secure the flexible element 206 until the actuator(s) are moved to release the flexible element 206 (see, e.g., actuators 250A, 250B in FIGS. 2A-2C). Depending on the type of locking assembly 203 that is included in the second element 204, the actuator(s) may be linear actuator(s), rotary actuator(s) or any combination thereof. As used herein, actuators may refer to levers, buttons, knobs, dials, slides and handles (among other items). Examples of actuators used in locking assemblies are provided below.

As shown in FIGS. 1A-1C, the example window opening control assemblies 200 described herein may be part of a window assembly 100 that includes a sash 104 and a window frame 102 where the first member 202 is attached to one of the window frame 102 or the sash 104 and the second member 204 is attached to the other of the window frame 102 or the sash 104. In the illustrated example embodiments, the first member 202 is attached to the window frame 102 and the second member 204 is attached to the sash 104.

Although the first and second members 202, 204 are shown as being coupled with the corners of the window frame 102 and the sash 104, it should be noted that the first and second members 202, 204 could be located elsewhere along the window. In addition, the first and/or second members 202, 204 may be formed as multiple assemblies on a single window. For example, multiple pairs of first and second members 202, 204 are installed at different locations on a window to provide redundant single or double action locking assemblies, described below, and restraints. In one example two single action (single actuator) members including a locking assembly requiring a single actuator to open and release the flexible element are coupled with a window along the sash and the frame. Optionally, the members are spaced from each other to require remote operation from each other and thereby further frustrate operation by children.

In some embodiments, the locking assembly 203 may be configured to automatically grasp and retain the anchor 216 when the first and second members 202, 204 are moved adjacent to one another, for instance from an open position where the flexible element 206 is decoupled from the first member 202. In addition, one or more of the locking assembly 203, tether 207 and anchor 216 may be designed to align the anchor 216 as the locking assembly 203 grasps and retains the flexible element 206 when the first and second members 202, 204 are moved adjacent to one another. For instance, in one example as the first member 202 is moved toward the second member 204 (with the flexible element 206 detached), the anchor 216 is received within a recess 218 (see FIGS. 2B, 2C) in the locking assembly 203 and guided into the locked configuration shown in FIGS. 2A, 2B. The taper of the recess 218 cooperates with the anchor 216 to ensure the anchor 216 is automatically secured by the locking assembly 203. Stated another way, the surfaces of each of the anchor 216 and the recess 218 are tapered and slide relative to each other to ensure locking engagement of the anchor 216 within the locking assembly upon movement of the first or second members 202, 204 relative to the other of the second and first members to an adjacent positions.

Alternatively, the flexible element 206 roughly aligns the anchor 216 (when detached from the locking assembly 203) with the recess 218 in the locking assembly 203 and thereby positions the anchor 216 on the second member 204 for reception and securing within the locking assembly 203. Stated another way, the flexible element provides a structural support that presents the anchor 216 in an orientation configured for reception within the locking assembly 203. For instance, while the flexible element 206 is retained within the second member 204, the portion of the flexible element 206 adjacent to the anchor 216 closely positions the anchor 216 at the second member 204 (see e.g., FIGS. 2C, 2D and 2F) and orients the anchor 216 to face toward the locking assembly 203. By orienting the anchor 216 movement of the first and second members 202, 204 to adjacent positions (e.g., where a sash is closed within a frame) reliably and automatically delivers the detached anchor 216 into the locking assembly 203 for locking engagement.

Several options for releasably locking the release member 216 with the first member 202 are shown in FIGS. 3A-11B. FIGS. 3A-11B are perspective and section views that illustrate a variety of different example locking assemblies which may be included in the example window opening control assembly 200.

Figure 3A:
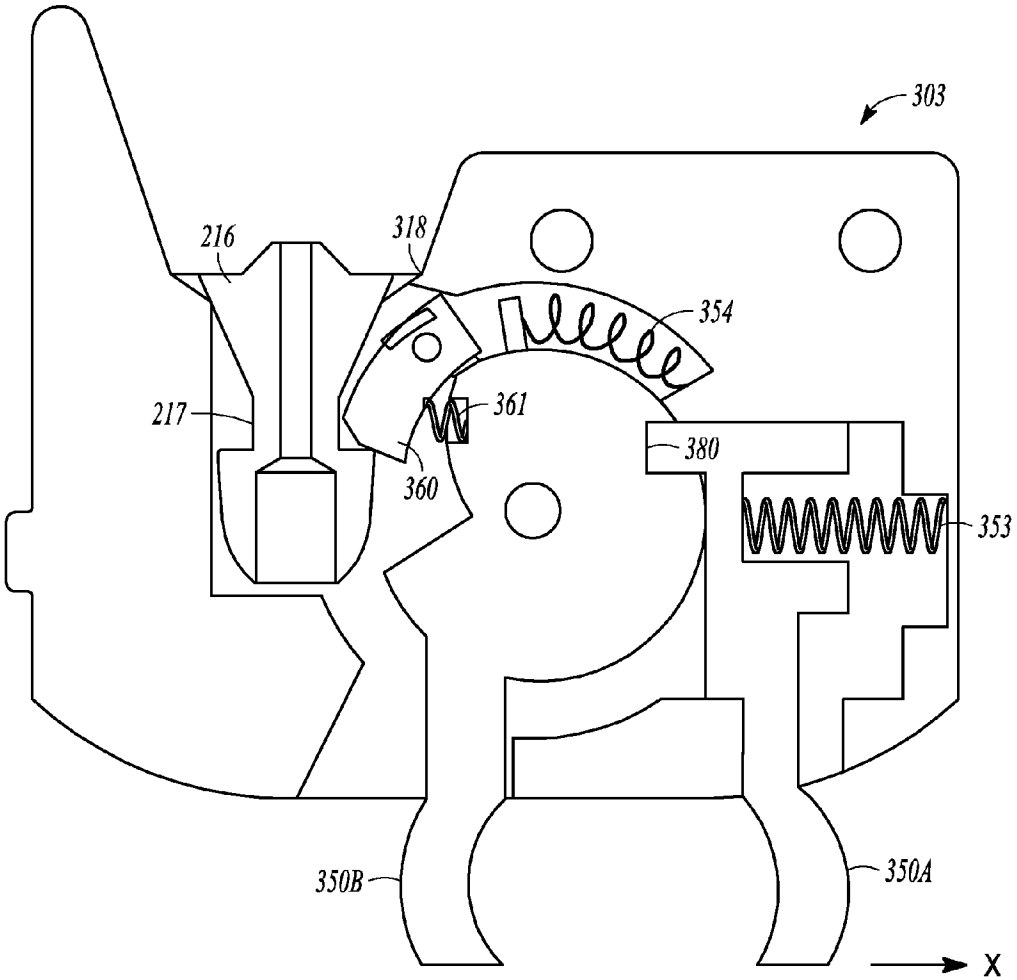
FIGS. 3A-11B are top views and perspective views of locking assemblies, as constructed in accordance with one embodiment.
Figure 3B:
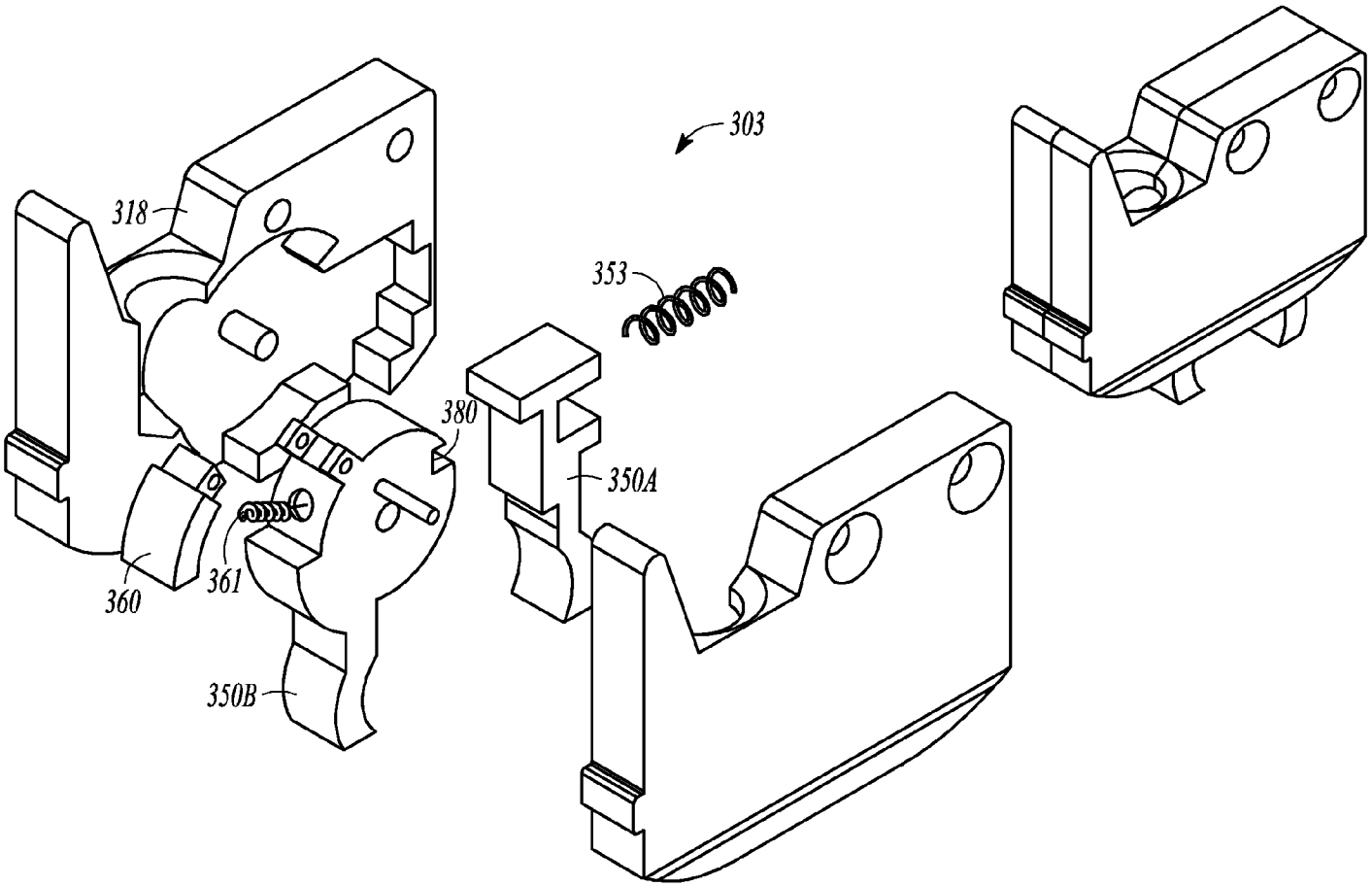

FIGS. 3A-3B illustrate an example locking assembly 303 that includes a first linear actuator 350A and a second rotary actuator 350B. The second rotary actuator 350B secures the anchor 216 and the first linear actuator 350A engages the second rotary actuator 350B such that second rotary actuator 350B can be disengaged from the anchor 216 only once the first actuator 350A is moved in the appropriate direction X.

The first linear actuator 350A is biased into a gap 380 in the second rotary actuator 350B by a compression spring 353. The second rotary actuator 350B is biased into a position that restrains the anchor 216 by another compression spring 354.

The second rotary actuator 350B includes a hinged member 360 that is biased into an open position by a compression spring 361. The hinged member 360 cooperates with the rotary actuator 350B to secure the anchor 216. The bias in the compression spring 361 is overcome in order to secure the anchor 216 when the anchor 216 is reseated in the locking assembly 303. During reseating, the hinged member 360 deflects inwardly and then resets within a groove 217 in the anchor 216 to affirmatively secure the anchor 216 in place.

Figure 4A:
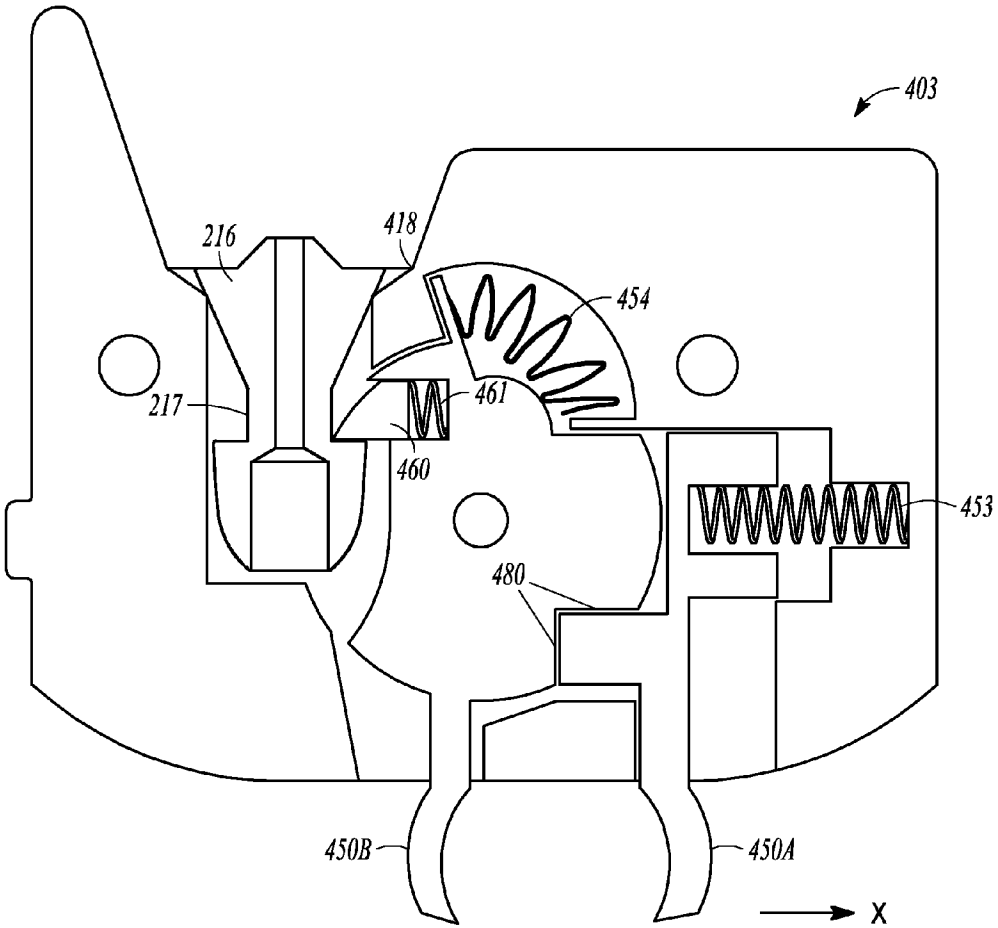
Figure 4B:
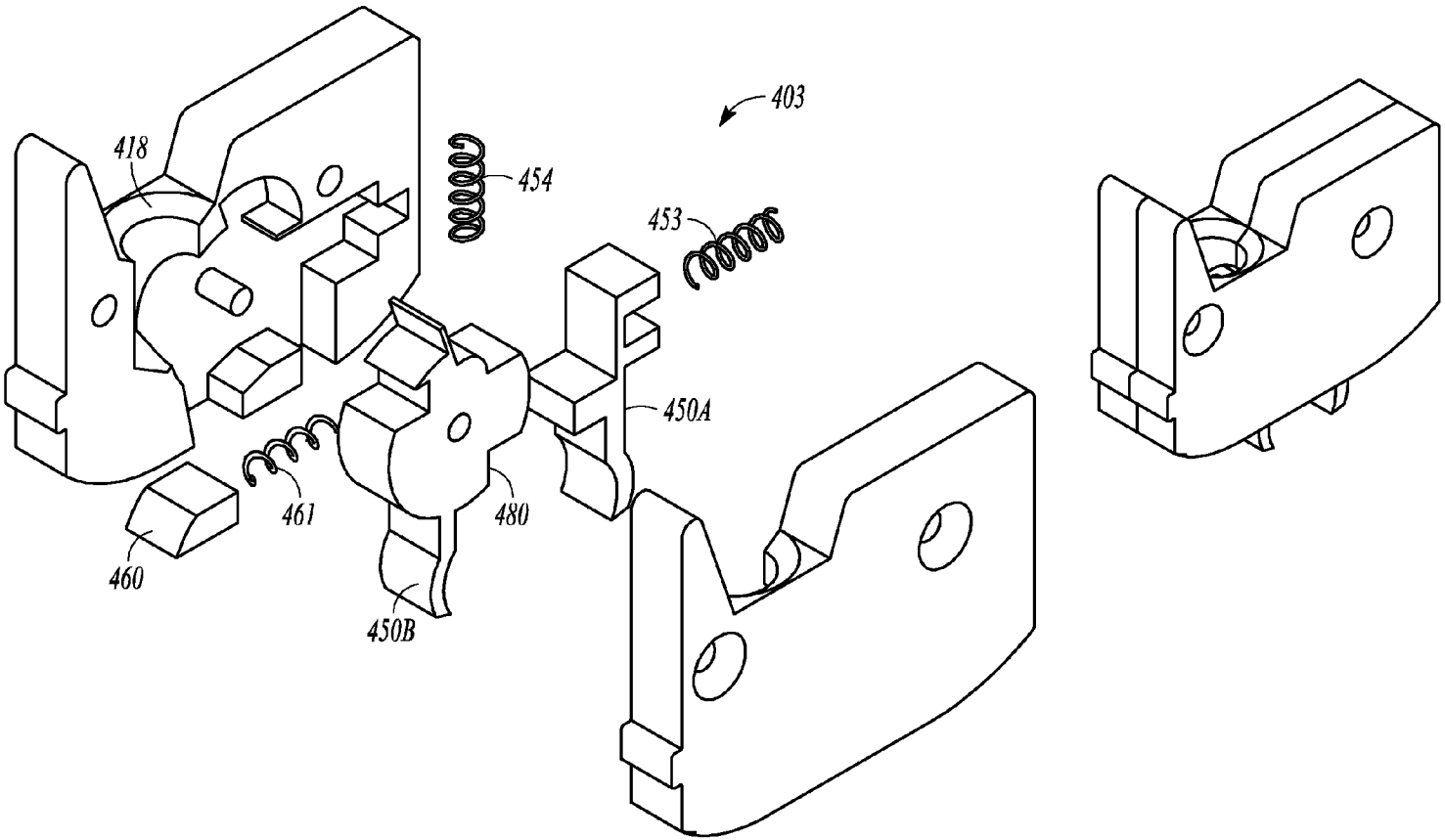

FIGS. 4A-4B illustrate another example locking assembly 403 that includes a first linear actuator 450A and a second rotary actuator 450B. The example embodiment that is illustrated in FIGS. 4A-4B is similar to the embodiment illustrated in FIGS. 3A-3B in that the second rotary actuator 450B secures the anchor 216 and the first linear actuator 450A engages the second rotary actuator 450B such that the second rotary actuator 450B can be disengaged from the anchor 216 only once the first actuator 450A is moved in the appropriate direction X. The locking assembly 403 illustrated in FIGS. 4A-4B is different than the locking assembly 303 illustrated in FIGS. 3A-3B in the second actuator 450B rotates in a different direction (e.g., clockwise) than the second actuator 350B in order to disengage the second actuator 450B from the anchor 216.

The first linear actuator 450A is biased into a gap 480 in the second rotary actuator 450B by a compression spring 453. The second rotary actuator 450B is biased into a position that restrains the anchor 216 by another compression spring 454.

The second rotary actuator 450B includes a catch member 460 configured for linear movement that is biased into an extended position by a compression spring 461 when the catch member 460 secures the anchor 216. The bias in the compression spring 461 is also overcome in order to secure the anchor 216 when the anchor 216 is reseated in the locking assembly 403. For instance, the anchor 216 deflects the catch member 460 inwardly (toward the linear actuator 450A) until the catch member 460 is free to slide into the groove 217 of the anchor 216.

Figure 5A:
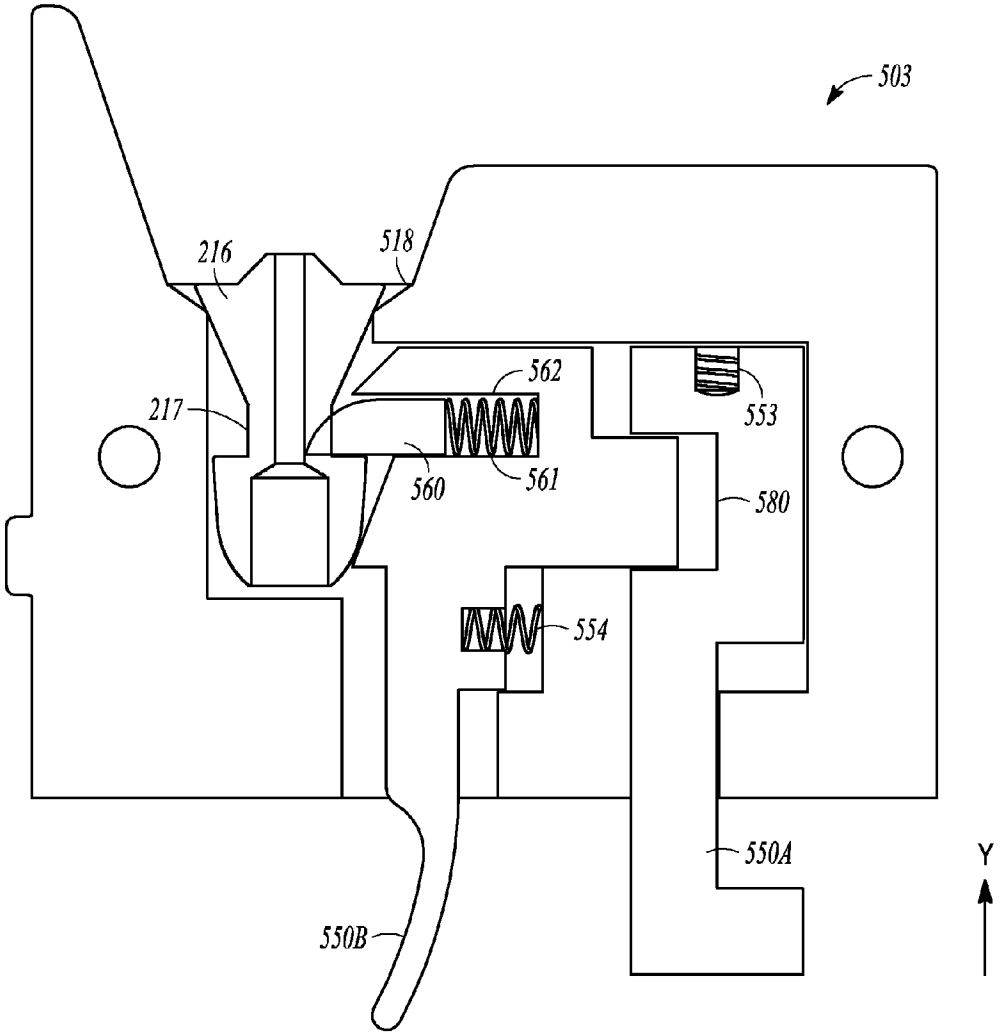
Figure 5B:
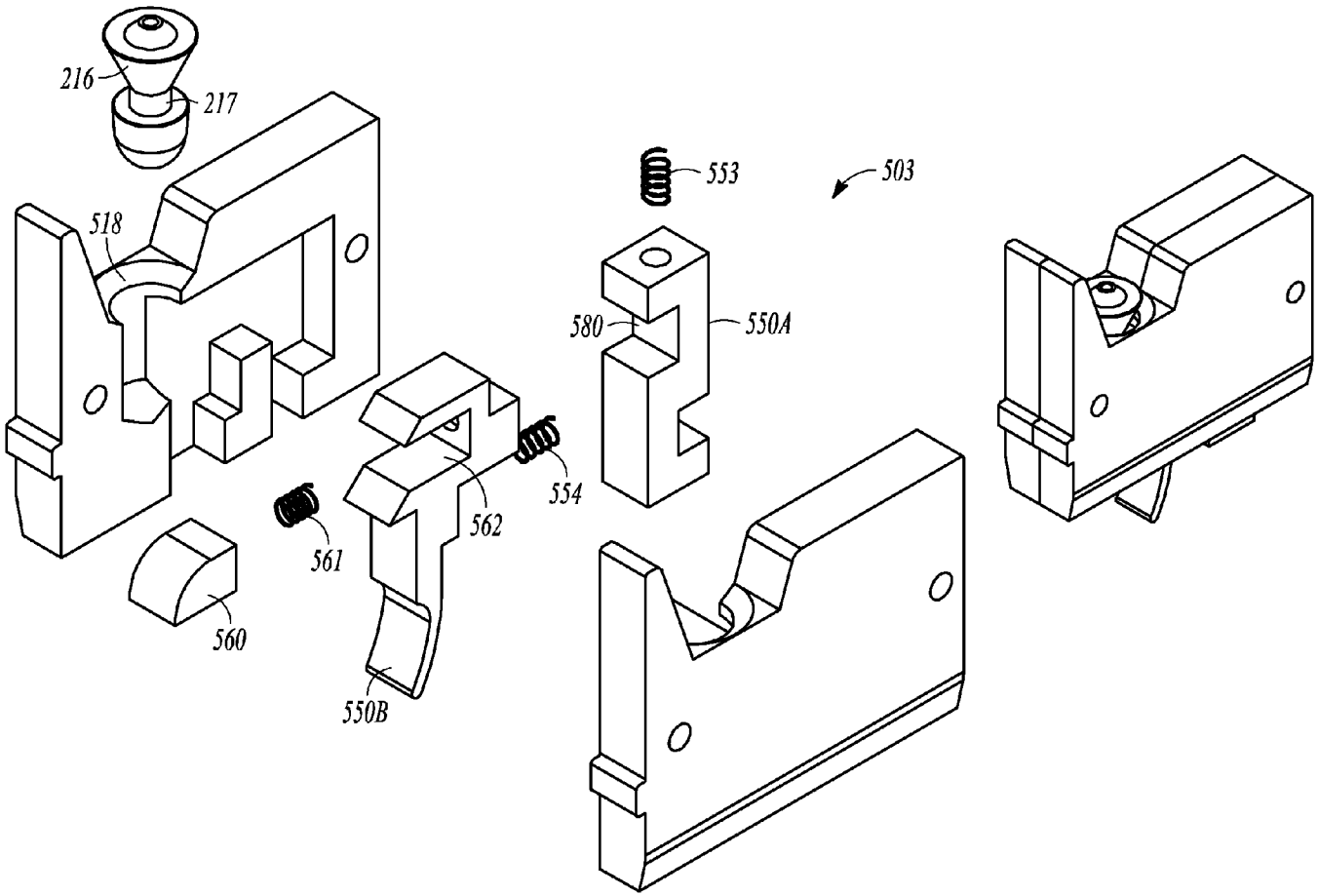

FIGS. 5A-5B illustrate another example locking assembly 503 that includes a first linear actuator 550A and a second linear actuator 550B. The second linear actuator 550B secures the anchor 216 and the first linear actuator 550A engages the second linear actuator 550B such that second linear actuator 550B can be disengaged from the anchor 216 only once the first linear actuator 550A is moved in the appropriate direction Y. The first and second linear actuators 550A, 550B are moved in directions that are substantially orthogonal to one another in order to disengage the second linear actuator 550B from the anchor 216 and to release the second linear actuator 550B from the first linear actuator 550A.

The first linear actuator 550A is biased by a compression spring 553 such that the second linear actuator 550B is unable to enter a gap 580 in the first linear actuator 550A unless the bias by compression spring 553 is overcome by pressing the first linear actuator 550A. The second linear actuator 550B is then biased into a position within a groove 217 in the anchor 216 by another compression spring 554 to affirmatively secure the anchor 216 in place.

The second linear actuator 550B includes a catch member 560 that is biased into an extended position by a compression spring 561 when the catch member 560 secures the anchor 216. As in previous examples, see for instance FIGS. 4A, B, the bias in the compression spring 561 is also overcome in order to secure the anchor 216 when the anchor 216 is reseated in the locking assembly 503. The anchor 216 deflects the catch member 560 inwardly (toward the second linear actuator 550A) until the catch member 560 is free to slide into the groove 217 of the anchor 216.

Figure 6A:
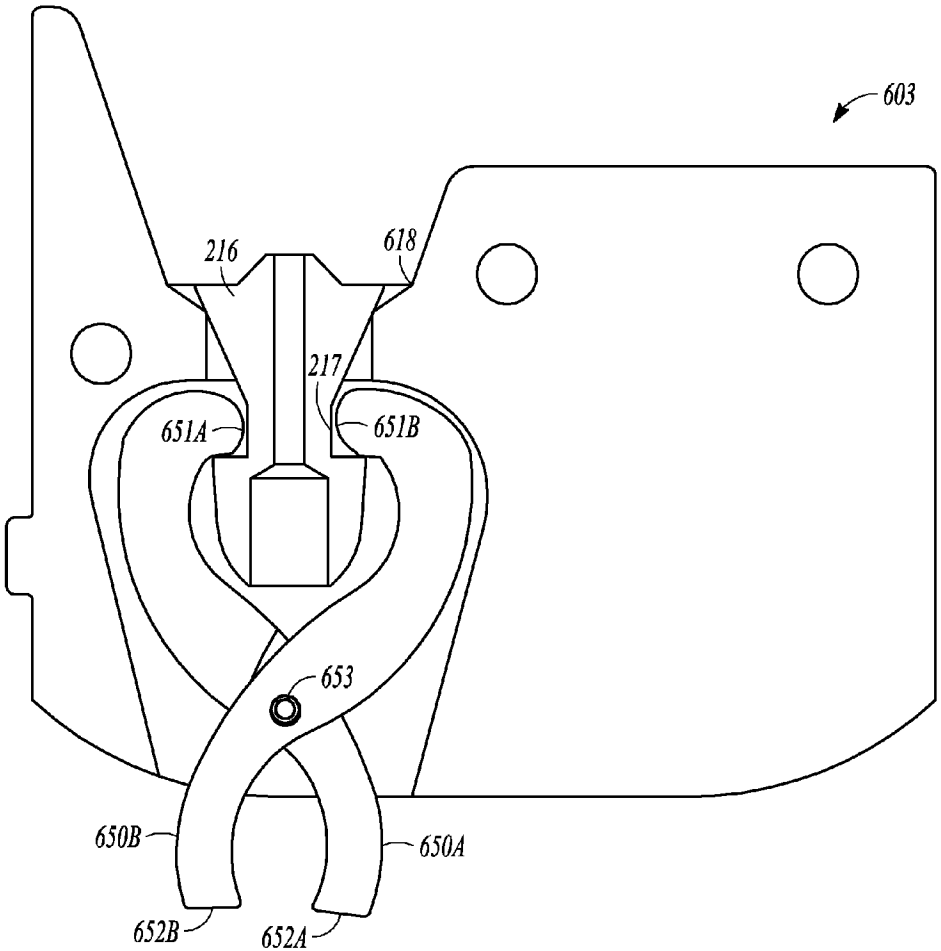
Figure 6B:
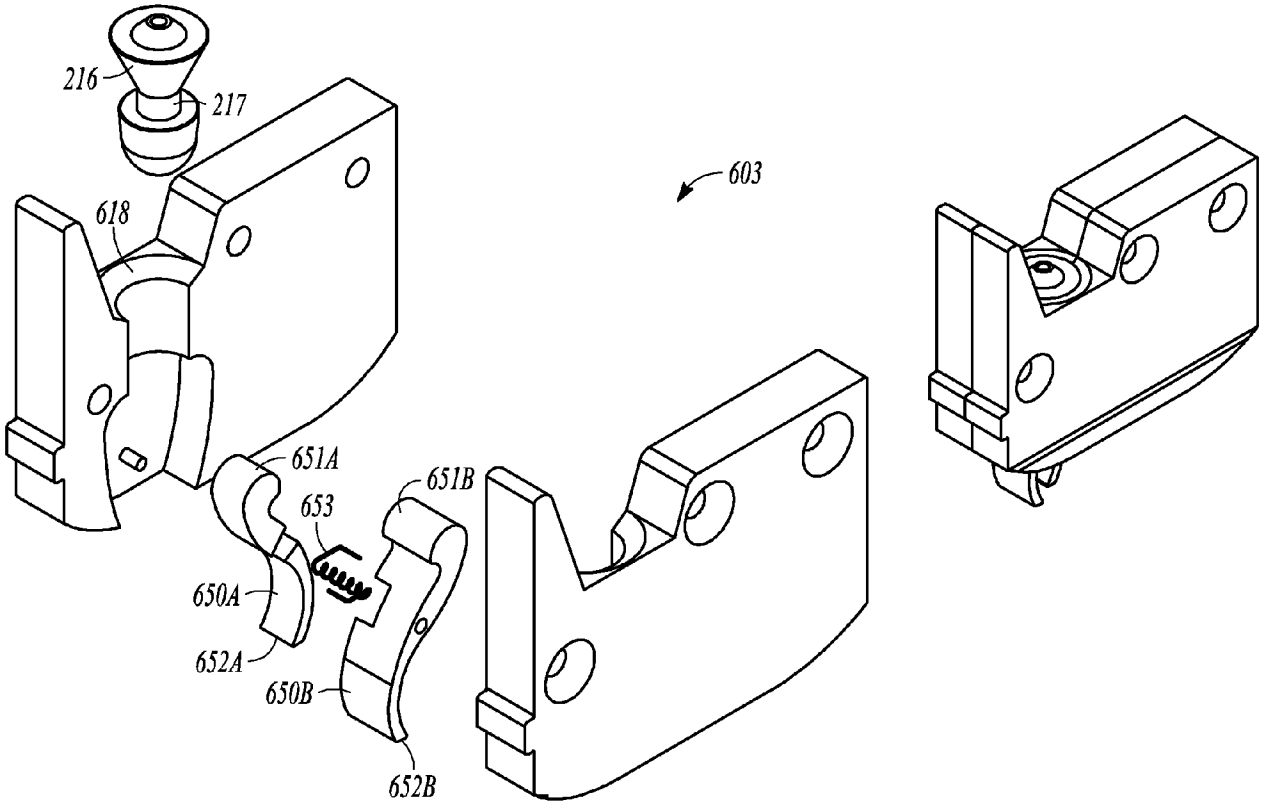

FIGS. 6A-6B illustrate another example locking assembly 603 that includes a first rotary actuator 650A and a second rotary actuator 650B. In the example embodiment that is illustrated in FIGS. 6A-6B, the first rotary actuator 650A and the second rotary actuator 650B are arranged in a scissors-type configuration such that the first actuator 650A and the second actuator 650B must be moved simultaneously in order to disengage the first actuator 650A and the second actuator 650B from the anchor 216. First ends 651A, 651B of the first and second rotary actuators 650A, 650B are biased toward one another by a torsion spring 653 in order to restrain the anchor 216. The locking assembly 603 is selectively deactivated by forcing second ends 652A, 652B of the first and second rotary actuators 650A, 650B toward one another (and causing first ends 651A, 651B to separate) in order to disengage the locking assembly 603 from the anchor 216.

The bias in the torsion spring 653 is overcome in order to secure the anchor 216 when the anchor 216 is reseated in the locking assembly 603. The anchor 216 deflects the first ends 651A, 651B outwardly until the first ends 651A, 651B are free to slide into the groove 217 of the anchor 216.

Figure 7A:
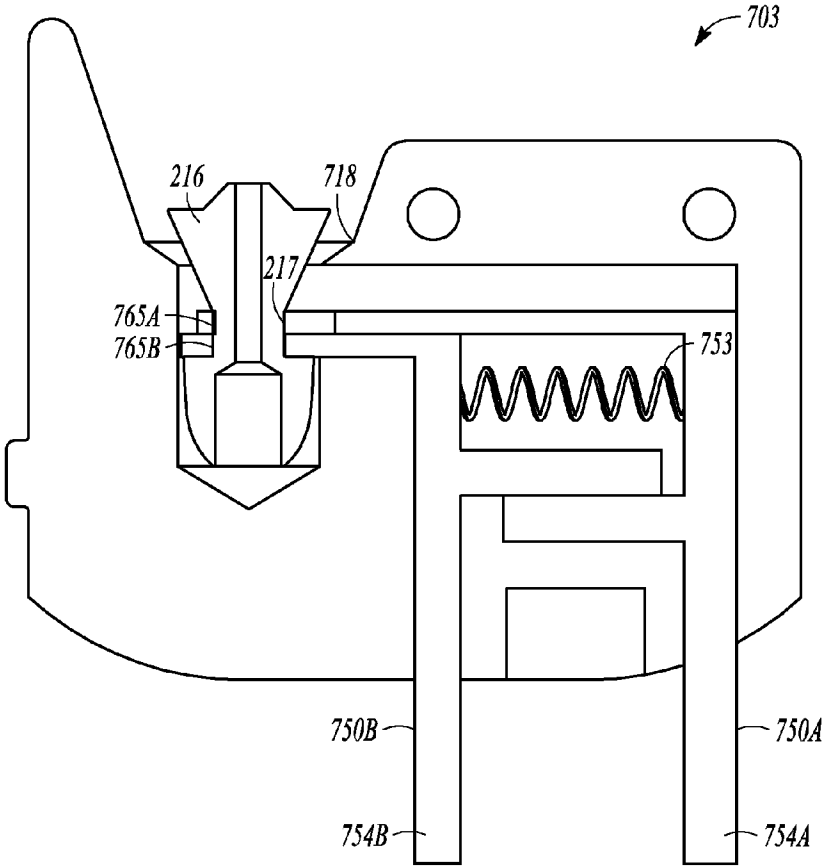
Figure 7B:
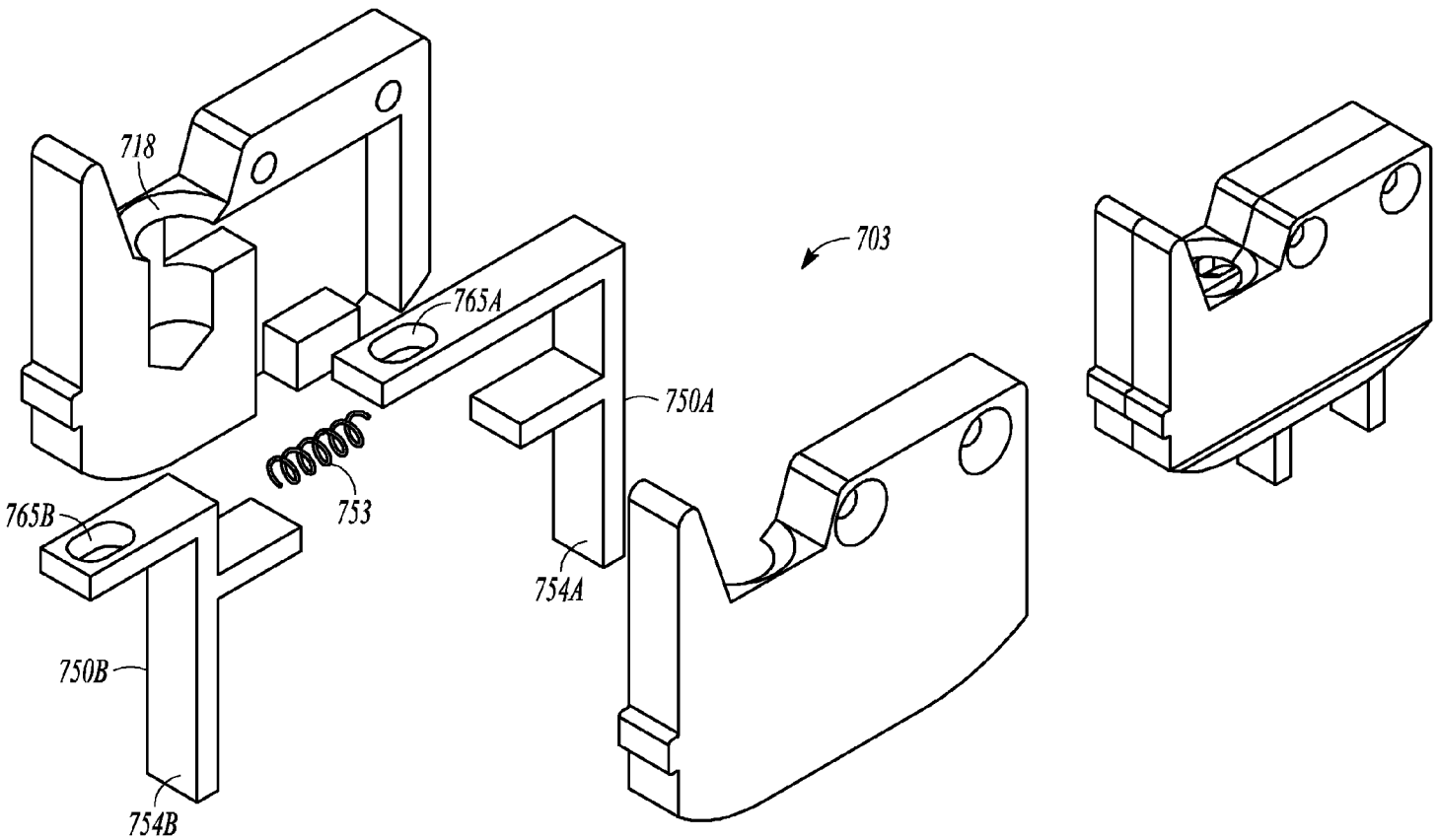

FIGS. 7A-7B illustrate another example locking assembly 703 that includes a first linear actuator 750A and a second linear actuator 750B. The first linear actuator 750A and the second linear actuator 750B are arranged adjacent to one another such that both levers 754A, 754B on the respective first and second linear actuators 750A, 750B must be manipulated in order to disengage the first linear actuator 750A and the second linear actuator 750B from the anchor 216.

The anchor 216 extends through an opening 765A in the first linear actuator 750A and an opening 765B in the second linear actuator 750B. The first and second linear actuators 750A, 750B are biased into engagement with the anchor 216 by a compression spring 753. The locking assembly 703 is selectively deactivated by simultaneously manipulating respective levers 754A, 754B on the first and second linear actuators 750A, 750B toward one another to allow the anchor 216 to exit the locking assembly 703 through both openings 765A, 765B in the first and second linear actuators 750A, 750B. Stated another way, the first and second linear actuators 750A, 750B engage in a vice-like engagement with the anchor 216 (e.g., within its groove) by engaging surfaces surrounding the openings 765A, B with anchor. By actuating the levers 754A, 754B the engagement is released.

The bias in the spring 753 is overcome in order to secure the anchor 216 when the anchor 216 is reseated in the locking assembly 703. The anchor 216 pushes through both openings 765A, 765B in the first and second linear actuators 750A, 750B and deflects the first and second linear actuators 750A, 750B outwardly until the first and second linear actuators 750A, 750B are free to slide inward into the groove 217 of the anchor 216.

Figure 8A:
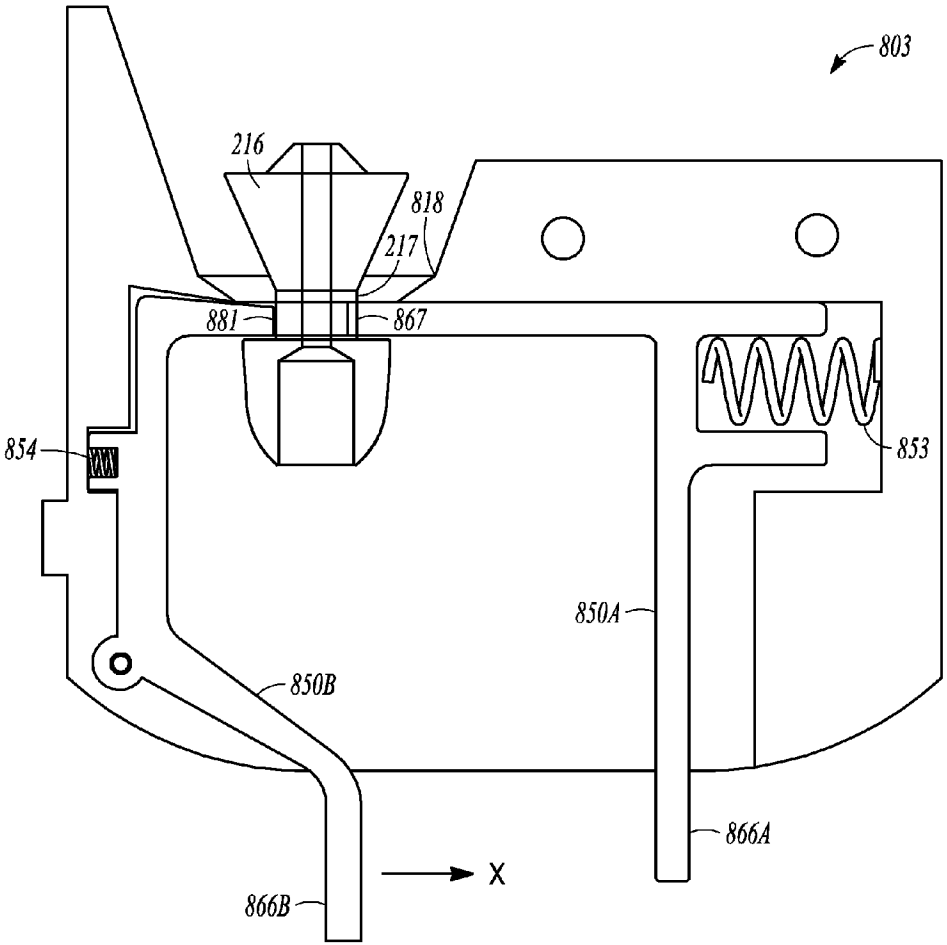
Figure 8B:
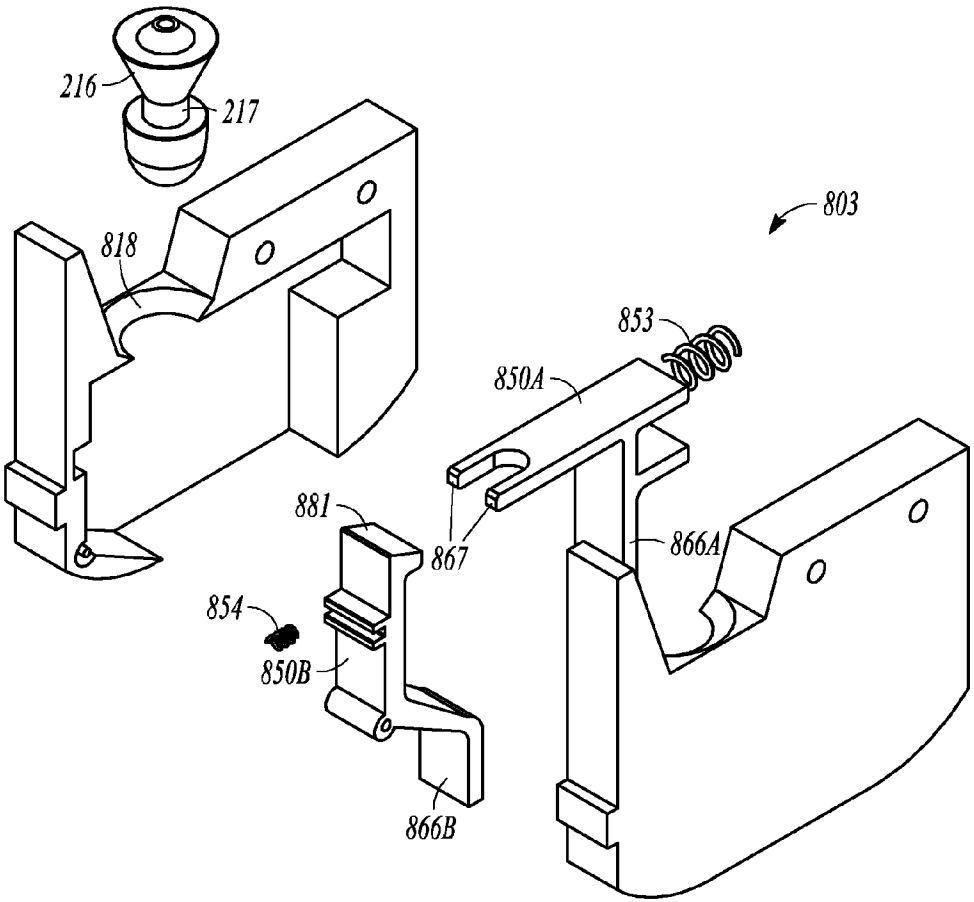

FIGS. 8A-8B illustrate another example locking assembly 803 that includes a first linear actuator 850A and a second rotary actuator 850B. The first linear actuator 850A and the second rotary actuator 850B are positioned such that levers 866A, 866B on the respective first and second actuators 850A, 850B must be manipulated in order to disengage the first linear actuator 850A and the second rotary actuator 850B from the anchor 216.

The first linear actuator 850A and the second rotary actuator 850B are biased into engagement with the anchor 216 by respective compression springs 853, 854. The locking assembly 803 is selectively deactivated by simultaneously manipulating the levers 866A, 866B in the same direction X to allow the anchor 216 to exit the locking assembly 803. In the example embodiment illustrated in FIG. 8, the first linear actuator 850A includes a fork 867 that engages the anchor 216 and the second rotary actuator 850B includes a projection 881 that engages the anchor 216.

The bias in the springs 853, 854 is overcome in order to secure the anchor 216 when the anchor 216 is reseated in the locking assembly 803. The anchor 216 deflects the fork 867 on the first linear actuator 850A and the projection 881 on the second rotary actuator 850B outwardly until the first linear actuator 850A and the second rotary actuator 850B are free to slide inwardly into the groove 217 of the anchor 216.

Figure 9A:
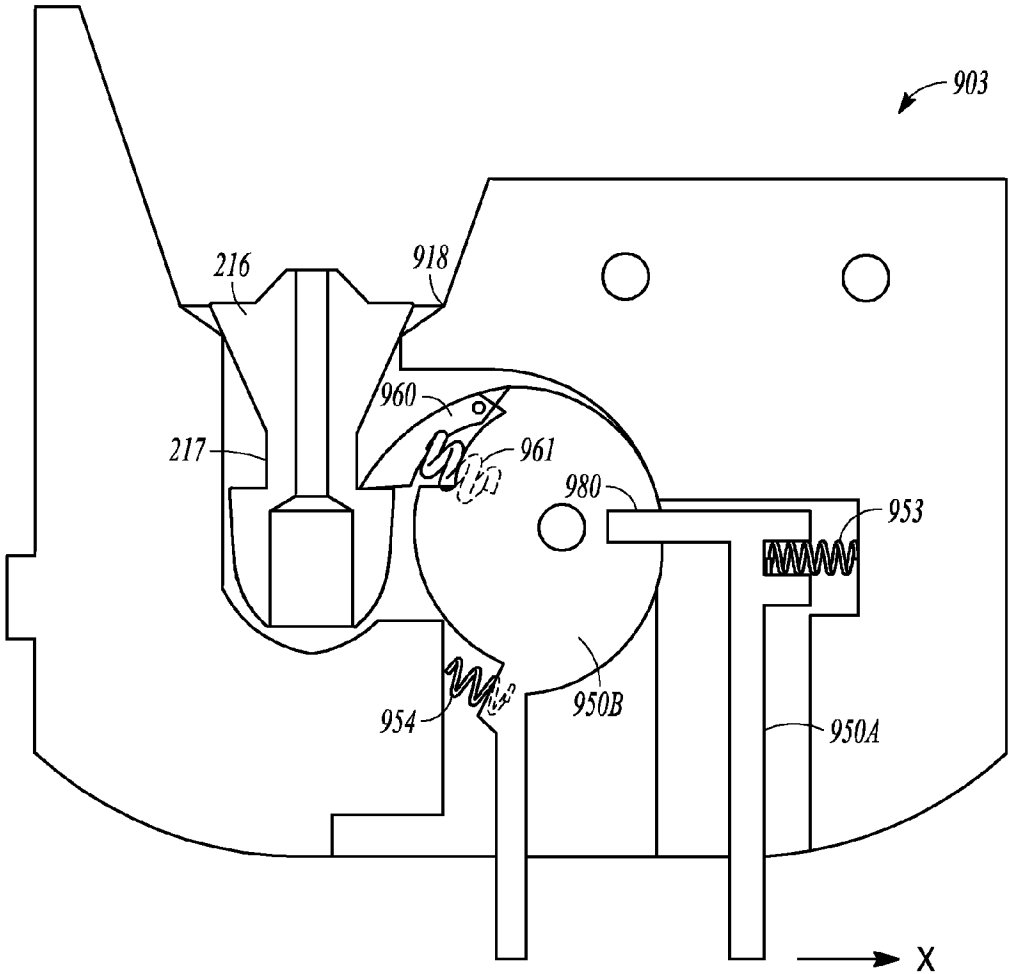
Figure 9B:
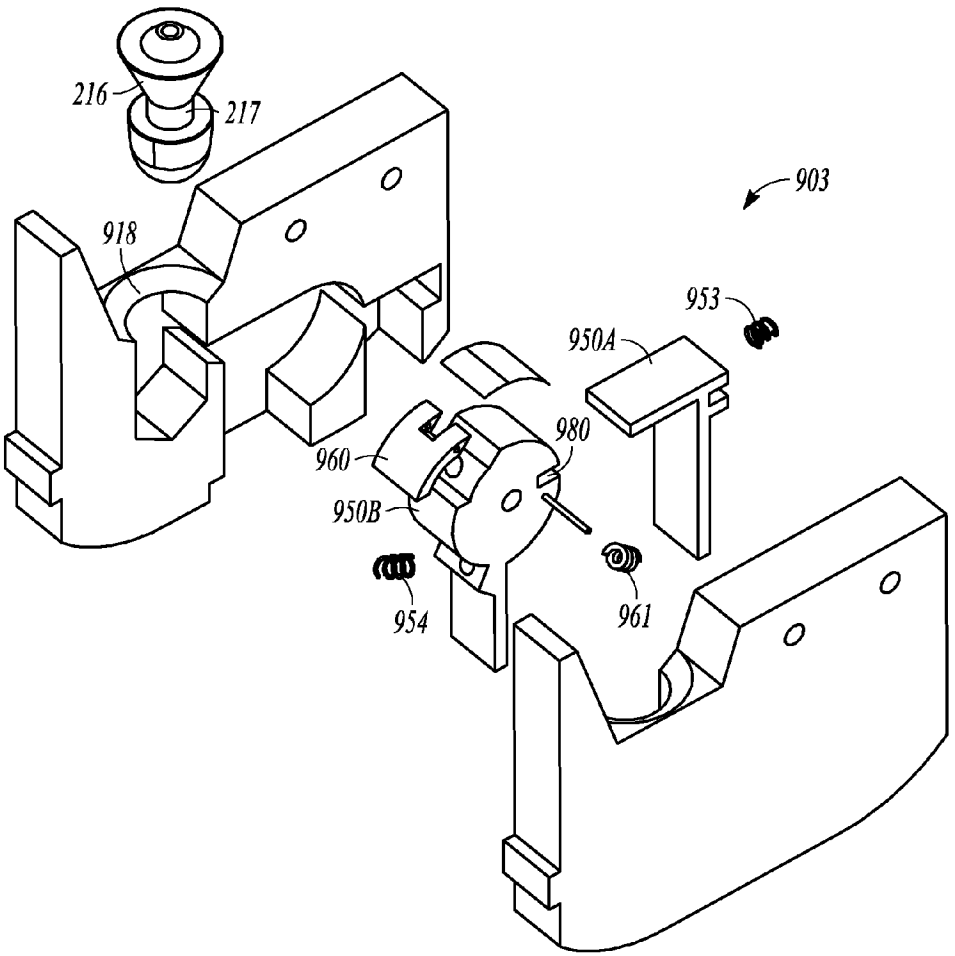

FIGS. 9A-9B illustrate an example locking assembly 903 that includes a first linear actuator 950A and a second rotary actuator 950B. The second rotary actuator 950B secures the anchor 216 and the first linear actuator 950A engages the second rotary actuator 950B such that the second rotary actuator 950B can be disengaged from the anchor 216 only once the first linear actuator 950A is moved in the appropriate direction X.

The first linear actuator 950A is biased into a gap 980 in the second rotary actuator 950B by a compression spring 953. The second rotary actuator 950B is biased into a position that restrains the anchor 216 by another compression spring 954.

The second rotary actuator 950B includes a hinged member 960 that is biased into an open position by a compression spring 961 when the hinged member 960 secures the anchor 216 (the compression spring 961 is interposed between an inside surface of the hinged member 960 and the second rotary actuator 950B). The bias in the compression spring 961 is also overcome in order to secure the anchor 216 when the anchor 216 is reseated in the locking assembly 903. During reseating, the hinged member 960 deflects inwardly and then resets within a groove 217 in the anchor 216 to affirmatively secure the anchor 216 in place.

Figure 10A:
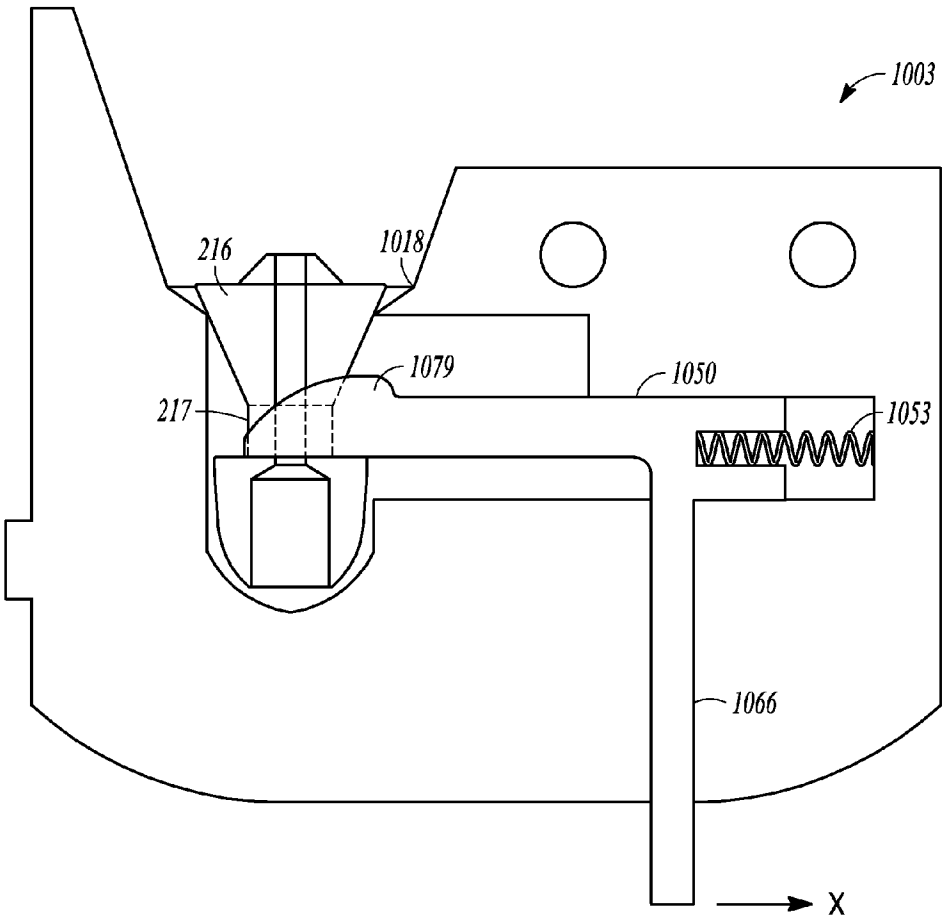
Figure 10B:
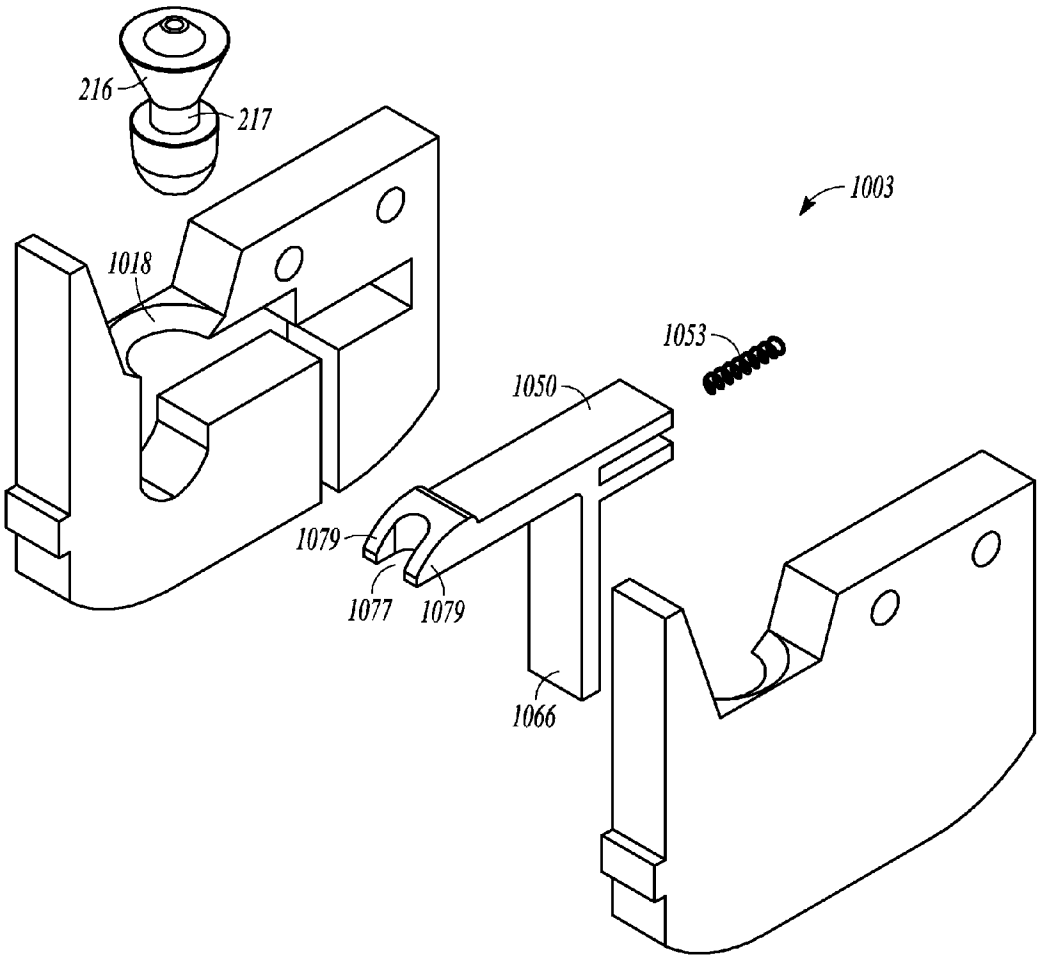

FIGS. 10A-10B show an example locking assembly 1003 that includes a single actuator, such as linear actuator 1050. The linear actuator 1050 is biased into engagement with the anchor 216 by a compression spring 1053 in order to secure the anchor 216. The anchor 216 is seated within a recess 1077 surrounded by one or more tines 1079 on the linear actuator 1150 when the anchor is secured by the locking assembly 1003. As the lever 1066 of the linear actuator 1050 is manipulated in the appropriate direction X, the anchor 216 unseats from the recess 1077 in the linear actuator 1050 and exits the locking assembly 1003.

The bias in the spring 1053 is overcome in order to secure the anchor 216 when the anchor 216 is reseated in the locking assembly 1003. The anchor 216 pushes on both tines 1079 of the linear actuator 1050 to deflect the linear actuator 1050 until the tines 1079 are free to slide into the groove 217 of the anchor 216.

Figure 11A:
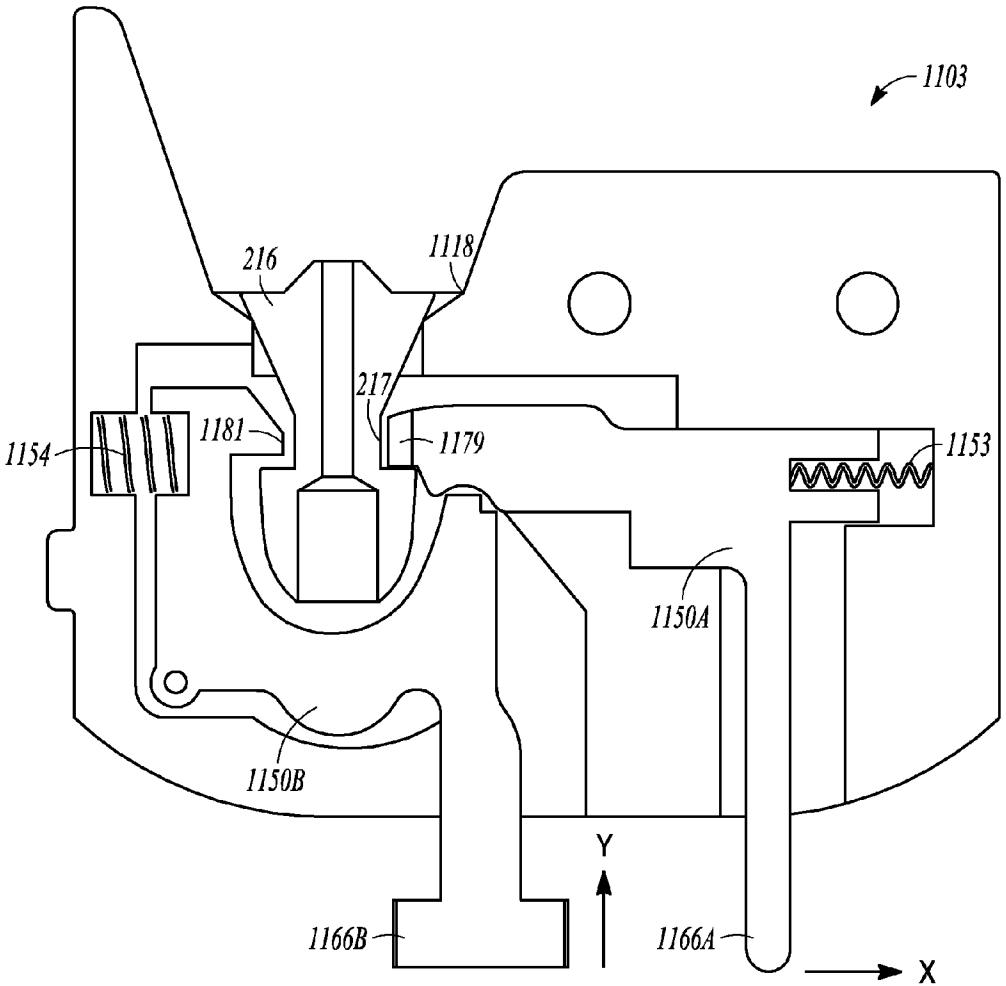
Figure 11B:
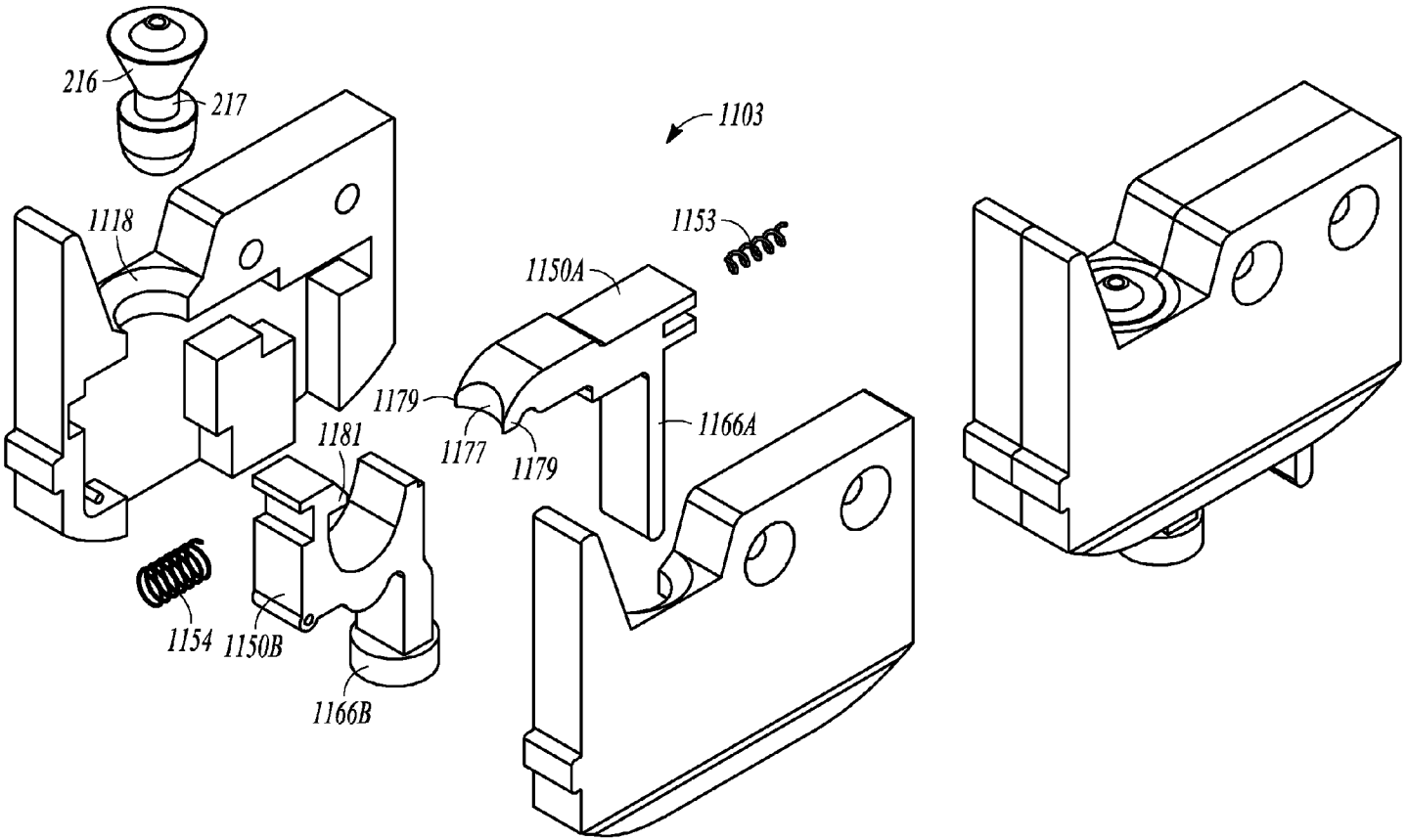

FIGS. 11A-11B illustrate another example locking assembly 1103 that includes a first linear actuator 1150A and a second rotary actuator 1150B. The first linear actuator 1150A and the second rotary actuator 1150B are positioned such that levers 1166A on the first actuator 1150A, and push button 1166B on the second actuator 1150B are manipulated in order to disengage the first linear actuator 1150A and the second rotary actuator 1150B from the anchor 216.

The first linear actuator 1150A and the second linear rotary actuator 1150B are biased into engagement with the anchor 216 by respective compression springs 1153, 1154. The anchor 216 is seated within a recess 1177 surrounded by one or more tines 1179 on the linear actuator 1150 when the anchor is secured by the locking assembly 1003. As the lever 1166A of the linear actuator 1050 is manipulated in the appropriate direction X, the anchor 216 is able to unseat from the recess 1077 in the linear actuator 1050. The anchor 216 is also secured below a projection 1181 on the rotary actuator 1150B when the anchor is secured by the locking assembly 1103. In addition, as the button 1166B of the linear actuator 1050 is manipulated in the appropriate direction Y, the bias in the spring 1154 is overcome and the anchor 216 unseats from the below the projection 1181 on the rotary actuator 1150B and exits the locking assembly 1103. Therefore, the locking assembly 1103 is selectively deactivated by manipulating lever 1166A and then pressing push button 1166B to allow the anchor 216 to exit the locking assembly 1103.

The illustrated example second rotary actuator 1154B is in the form of a push button 1166B. It should be noted that it is contemplated to have either, or both, of the first and second actuators 1150A, 1150B operate in the form of a push button in this embodiment as well as any of the other example embodiments described herein.

In addition, although the first actuator 1150A includes tines 1179 that secure the anchor 216 and the second rotary actuator 1150B includes a projection 1181 that engages the anchor 216, it should be noted that it is contemplated to have various other types of securing features engage the anchor 216 in this embodiment as well as any of the other example embodiments described herein. As examples, any of the actuators described herein may have a securing feature, including, but not limited to a fork, a tine, a catch, projection and the like.

The bias in the springs 1153, 1154 is overcome in order to secure the anchor 216 when the anchor 216 is reseated in the locking assembly 1103. The anchor 216 deflects the tines 1179 on the first linear actuator 1150A and the projection 1181 on the second rotary actuator 1150B outwardly until the tines 1179 on the first linear actuator 1150A and projection 1181 on the second rotary actuator 1150B are free to slide into the groove 217 of the anchor 216.

Figure 12:
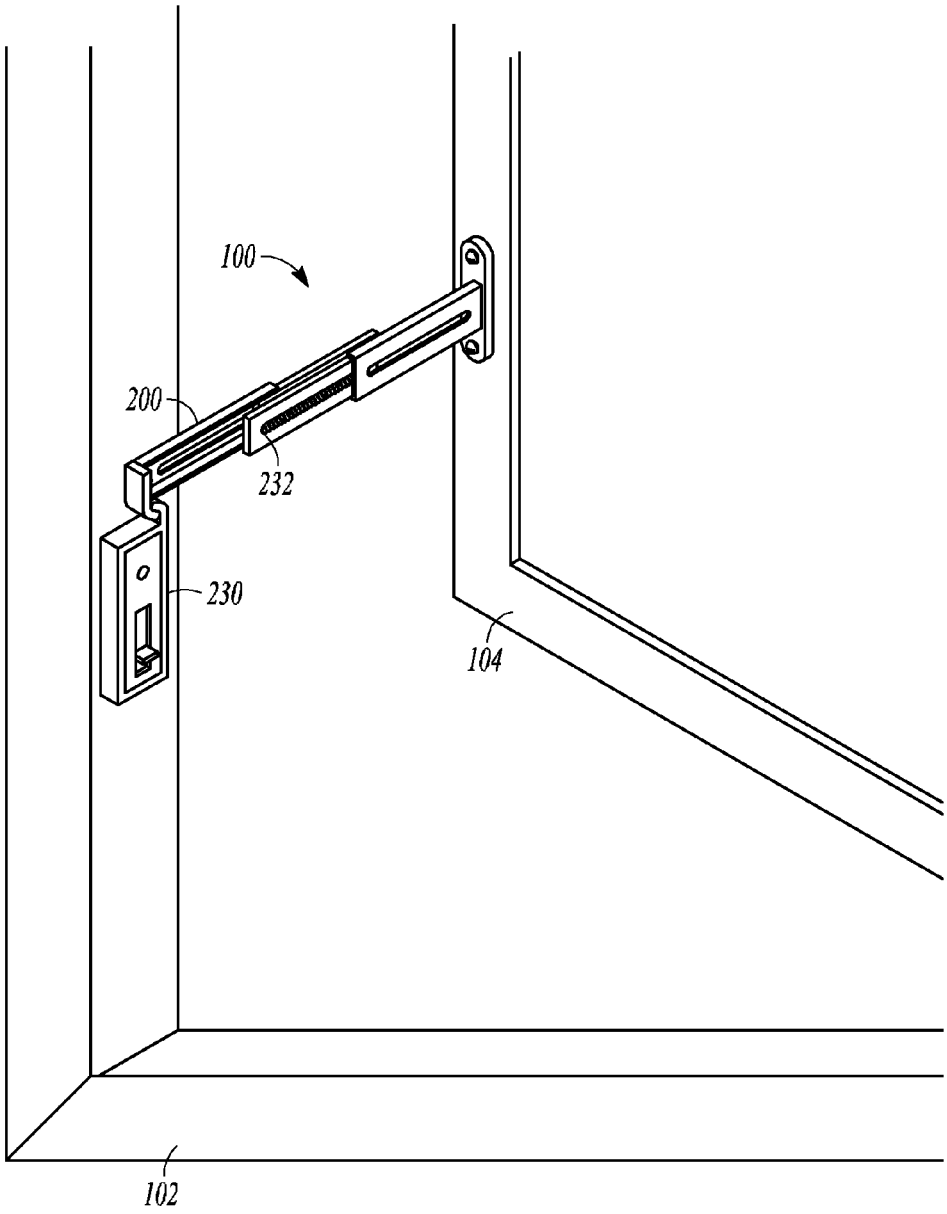
FIG. 12 is perspective view of a window assembly with another example of a window opening control assembly, as constructed in accordance with one embodiment.
Figure 13:
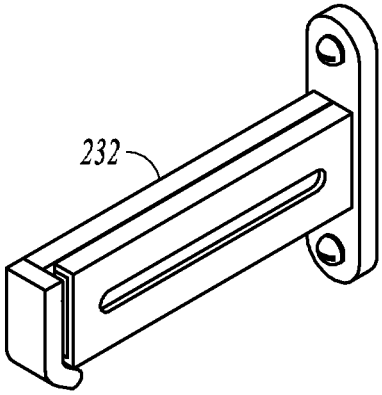
FIG. 13 is a perspective view of a telescoping window opening control assembly for the window assembly in a closed configuration, as constructed in accordance with one embodiment.
Figure 14:
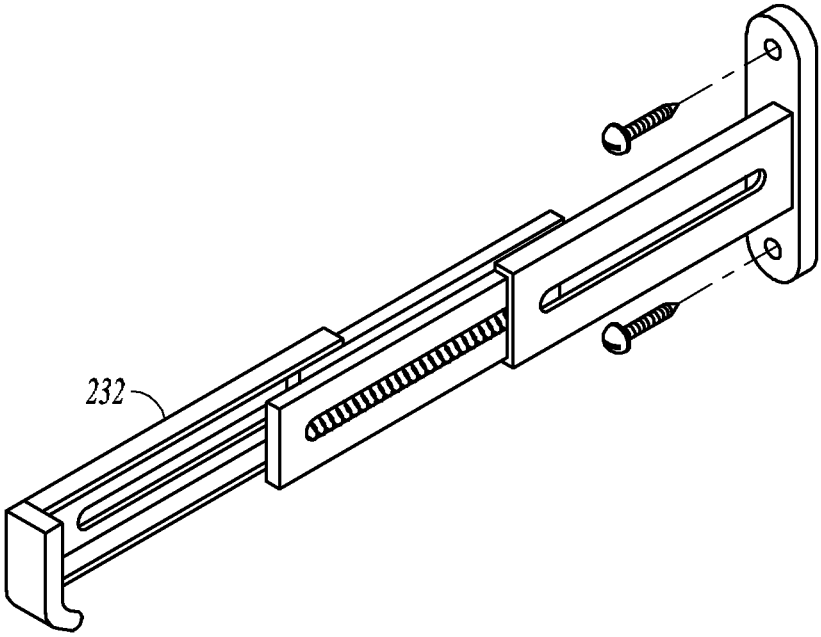
FIG. 14 is a perspective view of the telescoping window opening control assembly for the window assembly in an opened configuration, as constructed in accordance with one embodiment.
Figure 15:
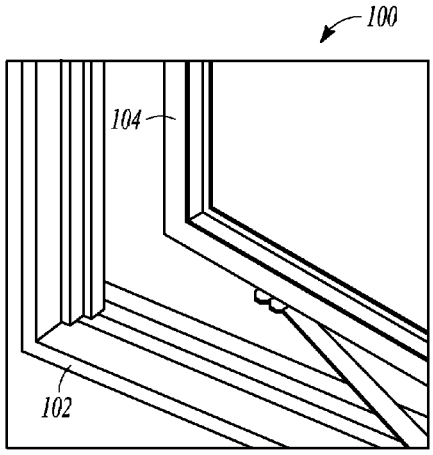
FIG. 15 illustrates a perspective view of a portion of a window assembly with yet another example of a window opening control assembly, as constructed in accordance with one embodiment.
Figure 16:
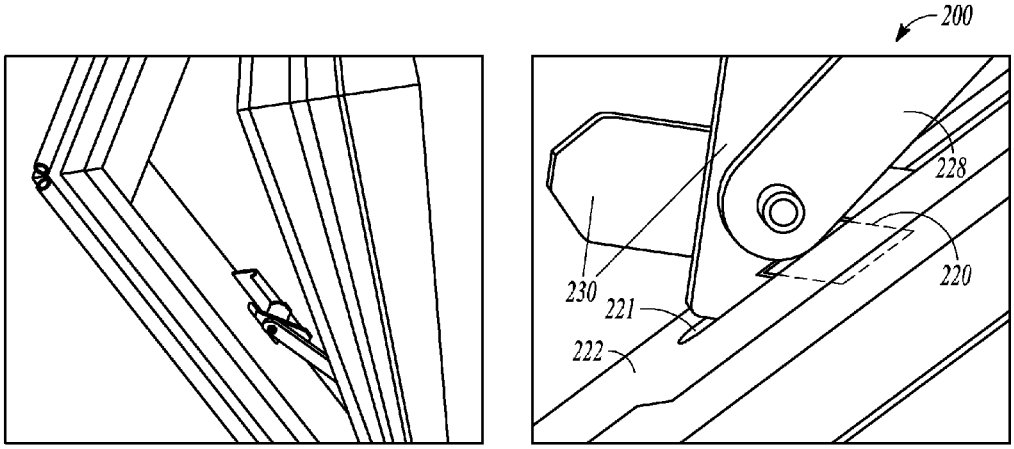
FIG. 16 illustrates a perspective view of a portion of a window assembly with the window opening control assembly of FIG. 15, as constructed in accordance with one embodiment.
Figure 17:
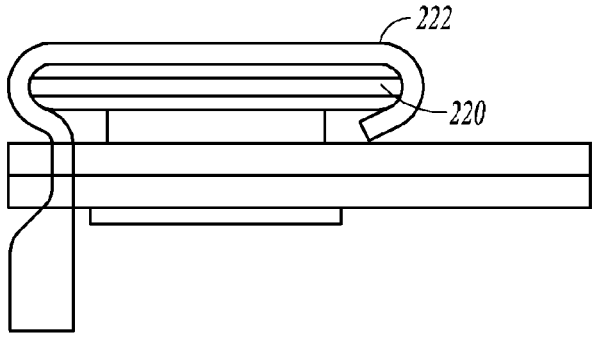
FIG. 17 illustrates a side view of a rail and release assembly for use in a window assembly, as constructed in accordance with one embodiment.
Figure 18:
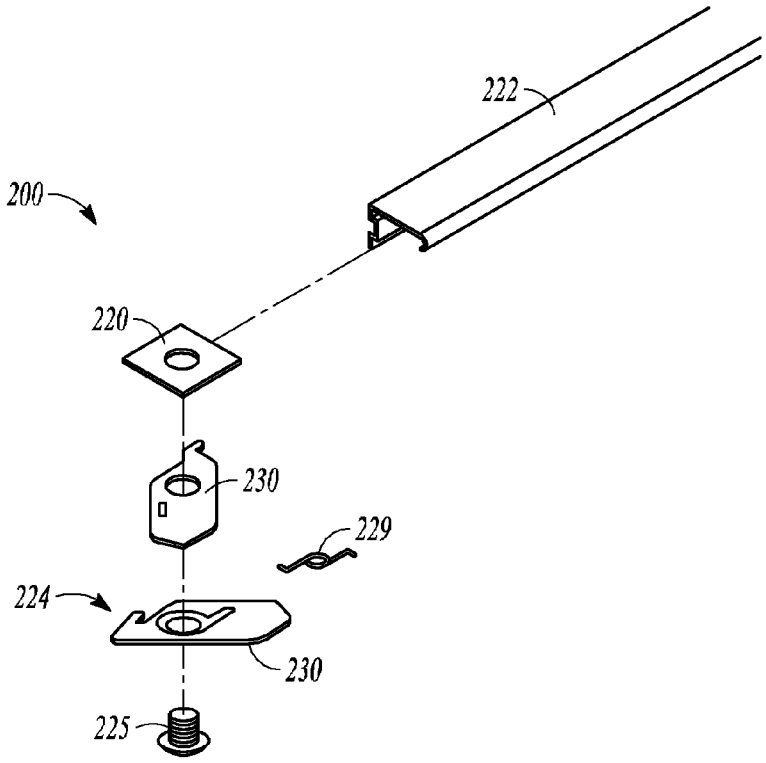
FIG. 18 illustrates an exploded perspective view of a portion of the rail and release assembly of FIG. 17, as constructed in accordance with one embodiment.

FIG. 12 illustrates another option of the window opening control assembly 200. In an option, a latch 230 is coupled with the frame 102. In an option, the latch 230 includes a hook-like projection that serves as a catch for a telescoping assembly 232 coupled with the sash 104. FIG. 13 shows the telescoping assembly 232 in a closed position, and FIG. 14 shows the telescoping assembly 232 in an open position. The telescoping assembly 232 includes members which slide relative to one another, and are spring loaded such that when unlatched from latch 230, the telescoping assembly 232 automatically returns to a closed position.

When the sash 104 of the window assembly 100 is being opened, the sash 104 will open to the length of the extended telescoping assembly 232 (see FIG. 13). The telescoping assembly 232 can be released from the latch 230, and the sash 104 then can be fully opened while the telescoping assembly 232 automatically returns to a closed position. The telescoping window opening control assembly 200 engages into a latch when the sash 104 is being closed. Although a casement window is illustrated, the telescoping window opening control assembly 232 can be used with other types of windows to restrict opening width.

FIGS. 15-18 illustrate another embodiment of the window assembly 100, including the window opening control assembly 200. The window opening control assembly 200 includes a block 220 and rail 222. In an option, the rail 222 is coupled with the sash 104, and the block 220 is coupled with a link 228 that is coupled with a crank of the frame 102. The block 220 rides within the rail 222. The rail 222 includes one or more openings 221 that provides a stop for a portion of a release assembly 224 and prevents the block 220 from sliding further along the rail 222. This limits the amount the sash 104 can open relative to the frame 102.

The release assembly 224 is further coupled with the block 220, for example, with a cylinder 225. The release assembly 224 is operable to be released from the openings of the rail 222, for example, when it is desirable for the sash 104 to open past the stop position. To release from the stop position, the user would back the sash 104 toward a more closed position, and then release the release assembly 224. In an option, the release assembly 224 includes a two opposing levers 230 that are coupled together with a bias member or a re-coil mechanism, such as, but not limited to, a torsion spring 229. To release the release assembly 224, the operator closes the sash 104 slightly to allow the lever arms 230 to disengage from the openings in the rail 222, and a second hand of the operator is used to depress both levers 230 and hold while cranking the sash 104 open past the stop position. In another option, the release can be done with a single-handed operation. For example, the sash 104 moves to the stop position. To release the release assembly 224, a first lever is depressed and the lever remains depressed. A second lever or button is depressed, operated, or manipulated and the sash 104 is released from the stop position. When the sash 104 is moved past the stop position, the engaging structures at the ends of the levers 230 would release and the levers 230 ride on the rail 222 again. As examples, the engaging structures may include, but are not limited to, hooks, feet, protrusions, detents, catches, bosses and the like.

After the levers 230 passes the stop position of the rail, the operator can operate without depressing the levers 230. In an option, when the sash 104 is closed, the sash opening control function of the rail and release assembly 224 will automatically reset and function again when the sash 104 is opened.

Figure 19:
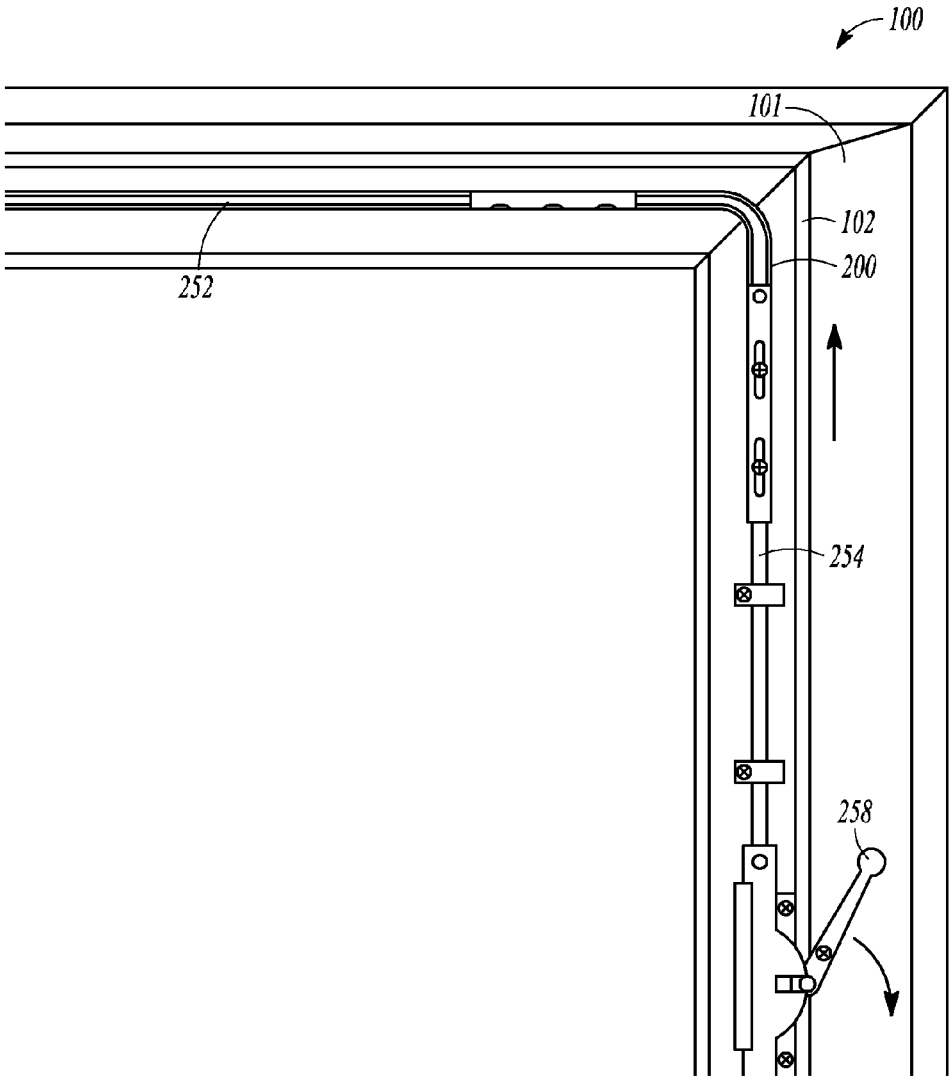
FIG. 19 illustrates a perspective view of a portion of a window assembly including still another example of a window opening control assembly, as constructed in accordance with one embodiment.
Figure 20:
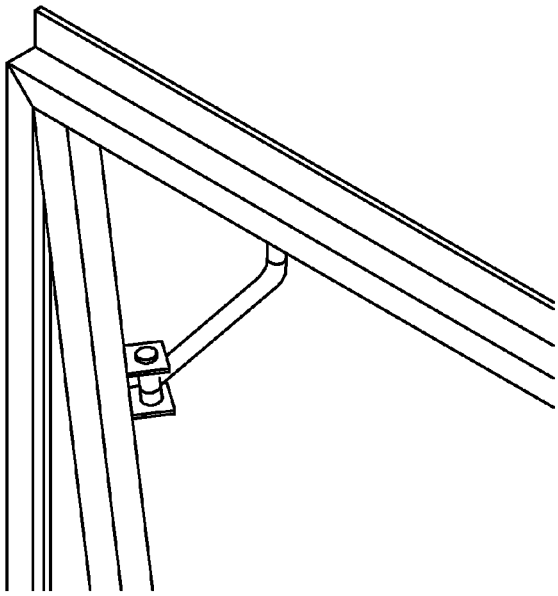
FIG. 20 illustrates a perspective view of a portion of a window assembly, as constructed in accordance with one embodiment.
Figure 21:
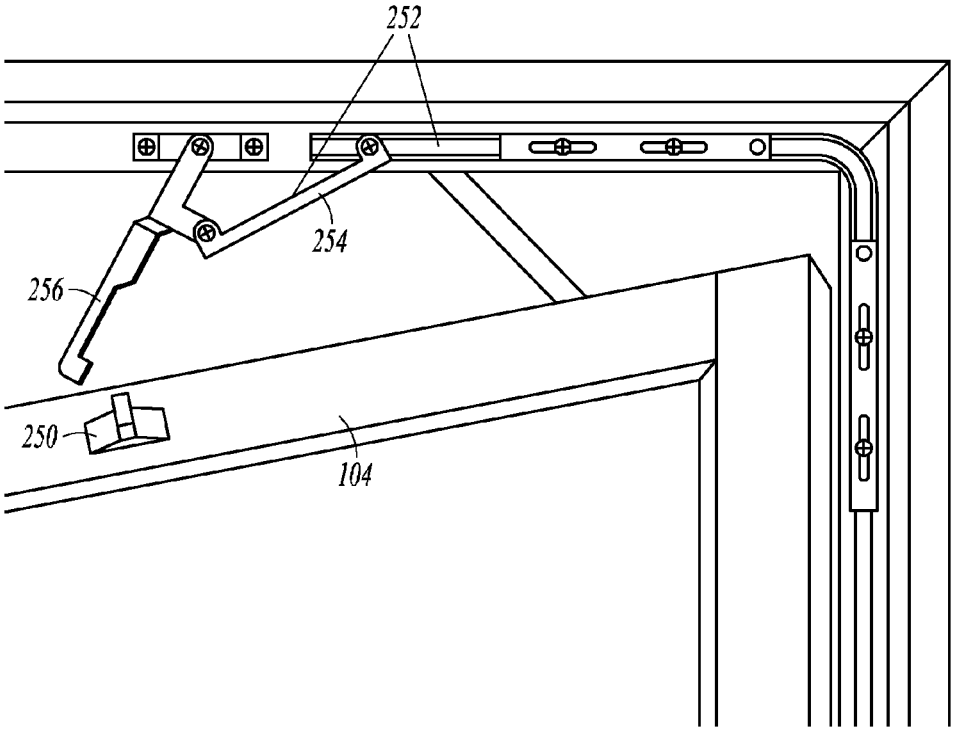
FIG. 21 illustrates a perspective view of a portion of a window assembly in the open position, as constructed in accordance with one embodiment.

FIGS. 19-21 illustrate another option for the window assembly 100 including a window opening control assembly 200, such as a corner traversing actuator with limiting assembly. The window opening control assembly 200 includes a catch 250 coupled with the sash 104, and a release assembly 252 coupled with the frame 102. The release assembly 252 includes a linkage 254 that includes a releasable lever catch 256. The linkage 254 traverses the top portion of the frame 102, extends around the corner 101 of the frame 102, and extends to an operator 258 near a lower portion of the vertical portion of the frame. In an option, the linkage 254 traverses a different portion of the frame 102 and extends around a different corner 101 of the frame 102 depending on the type of window that is included in the window assembly 100. In an option, the operator 258 is a lever.

During use, the sash 104 is cranked open and the lever catch 256 will allow the sash 104 to be opened until the lever catch 256 engages the catch 250 on the frame 102 at a stop position. The operator 258 is actuated and the linkage 254 causes the releasable lever catch 256 to rotate and disengage from the catch 250, and the sash 104 can be opened past the stop position. When the sash 104 is moved toward the closed position, in an option, there is automatic re-engagement. For example, the releasable lever catch 256 is automatically re-engaged with the catch 250 when the sash 104 is moved past the stop position, or upon fully closing the sash 104.

CONCLUSION

Several advantages of the window opening control assembly include, but are not limited to, the retractable flexible element, as well as other elements, do not protrude into the egress opening. Additional advantages include automatic re-engagement upon full closure of the window sash, non-handed assembly, and the window opening control assembly is adaptable to multiple window, door, roof hatch, skylight, sliding doors, and other designs.

The window assemblies and window opening control assemblies described herein limit window opening for safety by utilizing a tether that is secured by a locking assembly to restrict opening a window beyond the length of tether unless the locking assembly is released in a particular manner. In addition, the window assemblies and window opening control assemblies reliably and automatically reset the system upon closure by readily reseating an anchor that is at the end of the tether within the locking assembly. The window assemblies and window opening control assemblies also utilize a double action mechanism that requires at least two simultaneous operations, or two separate single operations in the same assembly or different assemblies at different locations in order to release the tether and allow a window to open beyond a certain point.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A window opening control assembly comprising:

a first member for attachment to one of a sash or a window frame, the first member including a locking assembly;

a second member for attachment to the other of the sash or the window frame, the second member including a flexible element that extends to the first member, the flexible element is secured by the locking assembly such that the flexible element is fed from the second member as the second member is moved away from the first member until the flexible element is anchored with the second member and the second member is correspondingly restrained from moving further away from the first member;

wherein the locking assembly includes a first actuator and a second actuator, wherein the second actuator secures the flexible element and the first actuator engages the second actuator such that the second actuator can be disengaged from the flexible element when the first actuator is moved, and the locking assembly is configured to automatically grasp and retain the flexible element when the first and second members are moved adjacent to one another; and wherein the locking assembly is selectively unlocked to permit removal of the flexible element from the locking assembly and permit continued movement of the second member away from the first member.

2. The window opening control assembly as recited in claim 1, wherein the flexible element includes a tether that has an anchor at the end of the tether such that the anchor is restrained by the locking assembly until the locking assembly is deactivated to permit the anchor to be removed from the locking assembly.

3. The window opening control assembly as recited in claim 2, wherein the second member includes a re-coil mechanism that is configured to retract the tether from the locking assembly when the locking assembly is selectively unlocked.

4. The window opening control assembly as recited in claim 3, wherein the re-coil mechanism is a compression spring.

5. The window opening control assembly as recited in claim 3, wherein the re-coil mechanism is a torsion spring.

6. The window opening control assembly as recited in claim 1, wherein the locking assembly includes an actuator that secures the flexible element, wherein the actuator releases the flexible element when the actuator is moved.

7. The window opening control assembly as recited in claim 6, wherein the actuator is a linear actuator.

8. The window opening control assembly as recited in claim 6, wherein the actuator is a rotary actuator.

9. The window opening control assembly as recited in claim 1, wherein the first actuator is a linear actuator and the second actuator is a linear actuator.

10. The window opening control assembly as recited in claim 1, wherein the first actuator is one of a linear or rotary actuator and the second actuator is one of a linear or rotary actuator.

11. The window opening control assembly as recited in claim 1, wherein the first actuator and the second actuator are movable simultaneously or sequentially in order to disengage the second actuator from the flexible element.

12. The window opening control assembly as recited in claim 1, wherein the first actuator and the second actuator are movable toward one another in order to disengage the second actuator from the flexible element.

13. The window opening control assembly as recited in claim 1, wherein the locking assembly secures the flexible element when the first and second members are moved adjacent to one another to engage the flexible element with the locking assembly.

14. The window opening control assembly as recited in claim 1, wherein one or more of the locking assembly and the flexible element aligns the flexible element at the locking assembly for grasping and retention of the flexible element when the first and second members are moved adjacent to one another.

15. The window opening control assembly as recited in claim 14, wherein the flexible element includes a tether and an anchor at the end of the tether, the locking assembly aligns the flexible element as the locking assembly grasps and retains the anchor.

16. The window opening control assembly as recited in claim 1, wherein the first member is configured to be attached to the window frame and the second member is configured to be attached to the sash.

17. A window assembly comprising:

a frame;

a sash movably coupled relative to the frame such that the sash is moveable between a closed position, a stopped intermediate position and an open position; and a window opening control assembly including:

a first member attached to one of the sash or the frame, the first member including a locking assembly, a second member attached to the other of the sash or the frame, the second member including a flexible element coupled with the first member, the flexible element is selectively secured by the locking assembly, wherein the flexible element is fed from the second member as the sash moves from the closed position until the sash reaches the stopped intermediate position and the flexible element arrests movement of the sash, and wherein the locking assembly is selectively unlocked to permit uncoupling of the flexible element from the locking assembly and permit continued movement of the sash from the stopped intermediate position toward the open position, the locking assembly includes a first actuator and a second actuator, and the first actuator and the second actuator are moved in order to uncouple the locking assembly from the flexible element.

18. The window assembly as recited in claim 17, wherein the flexible element includes a tether that has an anchor at the end of the tether such that the anchor is constrained by the locking assembly until the locking assembly is deactivated to permit the anchor to be removed from the locking assembly.

19. The window assembly as recited in claim 18, wherein the second member includes a re-coil mechanism that is configured to retract the tether from the locking assembly when the locking assembly is deactivated.

20. The window assembly of claim 17, wherein the locking assembly includes an actuator that secures the flexible element, wherein the actuator releases the flexible element when the actuator is moved.

21. The window assembly of claim 17, wherein the second actuator secures the flexible element and first actuator engages the second actuator such that second actuator can be disengaged from the flexible element when the first actuator is moved.

22. The window assembly as recited in claim 17, wherein the flexible element is received and anchored within the locking assembly when the first and second members are moved adjacent to each other.

23. The window assembly as recited in claim 17, wherein the first member is attached to the frame and the second member is attached to the sash.

24. A window opening control assembly comprising:

a first member for attachment to one of a sash or a window frame, the first member including a locking assembly that has a first actuator and a second actuator; and a second member for attachment to the other of the sash or the window frame, the second member including a flexible element having a tether and an anchor at an end of the tether, the anchor is selectively secured by the locking assembly;

wherein while the anchor is selectively secured by the locking assembly the tether is fed from the second member as the second member is moved away from the first member until the tether is anchored by the second member and arrests movement of the second member; and wherein the locking assembly is selectively unlocked by manipulating the first and second actuators to permit removal of the anchor from the locking assembly and permit continued movement of the second member away from the first member.

25. The window assembly of claim 24, wherein the second actuator secures the flexible element and first actuator engages the second actuator such that second actuator can be disengaged from the flexible element once the first actuator is moved.

26. The window assembly as recited in claim 24, wherein the second member includes a re-coil mechanism that is configured to retract the tether from the locking assembly when the locking assembly is deactivated.

27. The window opening control assembly as recited in claim 24, wherein the first actuator is a linear actuator and the second actuator is a linear actuator.

28. The window opening control assembly as recited in claim 24, wherein the first actuator is a rotary actuator and the second actuator is a rotary actuator.

29. The window opening control assembly as recited in claim 24, wherein the first actuator and the second actuator must be moved simultaneously or sequentially in order to disengage the second actuator from the anchor.

30. The window opening control assembly as recited in claim 24, wherein the locking assembly secures the anchor when the first and second members are brought close enough together to engage the anchor with the second actuator.

31. The window opening control assembly as recited in claim 24, wherein the first member is configured for attachment to the window frame and the second member is configured for attachment to the sash.

* * * * *